US010359732B2

(12) United States Patent
Hagiwara et al.

(10) Patent No.: US 10,359,732 B2
(45) Date of Patent: Jul. 23, 2019

(54) IMAGE FORMING APPARATUS

(71) Applicant: CANON KABUSHIKI KAISHA, Tokyo (JP)

(72) Inventors: Shinichi Hagiwara, Mishima (JP); Yuichiro Hirata, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/141,260

(22) Filed: Sep. 25, 2018

(65) Prior Publication Data

US 2019/0101860 A1 Apr. 4, 2019

(30) Foreign Application Priority Data

Sep. 29, 2017 (JP) ..... 2017-190428
Jun. 29, 2018 (JP) ..... 2018-124714

(51) Int. Cl.
*G03G 21/12* (2006.01)
*G03G 21/10* (2006.01)
(Continued)

(52) U.S. Cl.
CPC ..... *G03G 21/105* (2013.01); *G03G 15/081* (2013.01); *G03G 15/757* (2013.01);
(Continued)

(58) Field of Classification Search
CPC ..... G03G 21/105
See application file for complete search history.

(56) References Cited

U.S. PATENT DOCUMENTS 5,778,296 A * 7/1998 van der Steen ..... G03G 21/105 399/358
2009/0060536 A1 3/2009 Kumagai
(Continued)

FOREIGN PATENT DOCUMENTS

JP 2007183440 A 7/2007
JP 2012252257 A 12/2012
JP 2017102165 A 6/2017

OTHER PUBLICATIONS

Search Report issued in GB Appln. No. 1815576.2 dated Mar. 22, 2019.

*Primary Examiner* — Clayton E. LaBalle
*Assistant Examiner* — Jas A Sanghera
(74) *Attorney, Agent, or Firm* — Rossi, Kimms & McDowell LLP

(57) ABSTRACT

An image forming apparatus includes a cleaning unit removing toner remaining on an image bearing member after a toner image is transferred to an intermediate transfer member; a first storage unit which collects removed toner; a conveying unit which is driven by transmission of rotation of the image bearing member to convey toner in the first storage unit to a second storage unit; and a control unit which performs conveyance control, by driving the image bearing member to rotate during a non-image forming period, in which the conveying unit is caused to convey toner from the first storage unit to the second storage unit, wherein when an amount of toner in the first storage unit is equal to or larger than a threshold during an image forming period, the control unit executes the conveyance control during the non-image forming period to reduce the toner in the first storage unit.

12 Claims, 9 Drawing Sheets

(51) Int. Cl.
*G03G 21/18* (2006.01)
*G03G 15/00* (2006.01)
*G03G 15/08* (2006.01)

(52) U.S. Cl.
CPC ..... *G03G 21/12* (2013.01); *G03G 21/1814* (2013.01); *G03G 2221/0005* (2013.01); *G03G 2221/1627* (2013.01)

(56) References Cited

U.S. PATENT DOCUMENTS

| | | | |
|---|---|---|---|
| 2011/0097124 | A1 | 4/2011 | Koike et al. |
| 2016/0070200 | A1 | 3/2016 | Yamauchi |

* cited by examiner

IMAGE FORMING APPARATUS

BACKGROUND OF THE INVENTION

Field of the Invention

The present invention relates to an image forming apparatus.

Description of the Related Art

Conventionally, in an electrophotographic image forming apparatus using an electrophotographic image forming process, a process cartridge system is adopted in which an electrophotographic photosensitive member and a processing unit that acts on the electrophotographic photosensitive member are integrated into a cartridge to be attachable to and detachable from an image forming apparatus main body. According to the process cartridge system, since a user can personally perform maintenance of the apparatus without having to rely on service personnel, operability can be dramatically improved. Consequently, the process cartridge system is widely used in image forming apparatuses.

A process cartridge is generally provided with a photosensitive drum, a cleaning unit for removing toner on a surface of the photosensitive drum, a charging unit, a developing unit, and a waste toner storage portion which stores waste toner removed by the cleaning unit.

The waste toner in the waste toner storage portion is conveyed by a screw-shaped conveying member provided in the storage portion in a longitudinal direction of the conveying member, sent to a toner accepting portion of an apparatus main body, and conveyed to a collection container installed in the apparatus main body.

Japanese Patent Application Publication No. 2017-102165 describes a configuration in which, in an attachable/detachable unit having such a waste toner collection configuration, a conveying member which conveys waste toner is driven by transmission of a rotation of a photosensitive drum.

When a waste toner conveying member is rotated by drive transmission of a photosensitive drum as in Japanese Patent Application Publication No. 2017-102165, since an amount of conveyed waste toner per unit time depends on a drive speed of the photosensitive drum, there is an upper limit to the amount of waste toner that can be conveyed during image formation. During an image forming period such as a high-quality mode or a high-density mode in which the amount of waste toner increases as compared to a standard image formation mode, the amount of waste toner in the waste toner storage portion may reach an upper limit of the amount of waste toner which the waste storage portion can store due to discharge of waste toner from the waste toner storage portion to the apparatus main body failing to catch up with the increase in waste toner. In this case, there is a possibility that problems such as clogging of waste toner inside the waste toner storage portion may occur.

Conceivable ways to address such problems include increasing a volume of the waste toner storage portion and increasing a diameter of the conveying screw. However, due to demands to downsize process cartridges, the challenge is to convey waste toner to a main body collection container with maximum efficiency while suppressing an increase in the volume of a waste toner storage portion.

The present specification discloses a technique for preventing waste toner from being excessively stored in a waste toner storage portion in an image forming apparatus.

SUMMARY OF THE INVENTION

A first aspect of the present invention is an image forming apparatus including:

an image bearing member which is rotationally driven;

a developing unit which, during an image forming period, is arranged to supply toner to the image bearing member and to form a toner image on the image bearing member;

a transfer unit which is arranged to transfer the toner image to an intermediate transfer member or a recording medium;

a first cleaning unit which is arranged to remove, from the image bearing member, toner remaining on a surface of the image bearing member after the toner image is transferred to the intermediate transfer member or recording medium;

a first storage unit arranged to receive and collect toner removed by the first cleaning unit;

a conveying unit which is arranged to be driven by transmission of a rotation of the image bearing member to convey toner stored in the first storage unit to a distinct second storage unit; and a control unit which is arranged to perform conveyance control, by driving the image bearing member to rotate during a non-image forming time period, during which time period the conveying unit is caused to convey toner from the first storage unit to the second storage unit, wherein the control unit being arranged to calculate an amount of toner, stored in the first storage unit, during the image forming period, and when the amount of stored toner is equal to or larger than a prescribed threshold, the control unit is arranged to execute the conveyance, during the non-image forming period, of toner from the first storage unit to the second storage unit, to reduce the amount of toner stored in the first storage unit.

A second aspect of the present invention is an image forming apparatus including:

an image bearing member which bears a developer image;

a frame body which rotatably supports the image bearing member and which has a storage portion that stores a developer collected from a surface of the image bearing member;

a conveying member which is supported by the frame body so as to rotate and which is configured to operate, driven by transmission of a drive force that rotates the image bearing member, conveyance in which a developer stored in the storage portion is conveyed from the inside of the storage portion to the outside of the storage portion; and a control unit which causes the conveying member to operate the conveyance, wherein the control unit is arranged to calculate an amount of the developer stored in the storage portion during an image forming time period, and when the amount of the stored developer is equal to or larger than a threshold, the control unit is arranged to cause the conveyance operation of toner from the inside of the storage portion to the outside of the storage portion to be executed during a non-image forming period to reduce the amount of the developer stored in the storage portion.

According to the technique disclosed in the present specification, waste toner can be prevented from being excessively stored in a waste toner storage portion in an image forming apparatus.

Further features of the present invention will become apparent from the following description of exemplary embodiments with reference to the attached drawings.

DESCRIPTION OF THE EMBODIMENTS

Image forming apparatuses according to embodiments of the present invention will be described with reference to the drawings. In the respective configurations disclosed in the embodiments, materials, arrangements, dimensions, other numerical values, and the like are not limited to those described unless otherwise specifically noted to the contrary. In addition, the term "above" refers to upward in a direction of gravitational force when installing the image forming apparatus unless otherwise expressly provided. Each of the embodiments of the present invention described below can be implemented solely or as a combination of a plurality of the embodiments. Also, features from different embodiments can be combined where necessary or where the combination of elements or features from individual embodiments in a single embodiment is beneficial

First Embodiment

A feature of an image forming apparatus according to a first embodiment is that the image forming apparatus obtains (calculates) an amount of toner (developer) used during an image forming period, obtains (calculates) an amount of waste toner stored in a waste toner storage portion based thereon, and performs waste toner conveyance control based on the obtained amount of waste toner.

The image forming apparatus forms an image on a recording medium using an electrophotographic image forming process. Examples of image forming apparatuses using an electrophotographic image forming process include an electrophotographic copier, an electrophotographic printer (such as an LED printer or a laser beam printer), and an electrophotographic facsimile device. A process cartridge has a photosensitive drum (an image bearing member) and a developing unit which develops a latent image formed on the photosensitive drum, and is attachable to and detachable from an image forming apparatus main body (hereinafter, an apparatus main body). A unit which integrates a photosensitive drum, a coupling member, and the like used in a process cartridge is referred to as a photosensitive unit. The image forming apparatus is a full-color image forming apparatus with four process cartridges attachable thereto and detachable therefrom. Note that the number of process cartridges described above is merely an example and the number of process cartridges is not limited thereto.

Overall Configuration of Image Forming Apparatus

Figure 1:
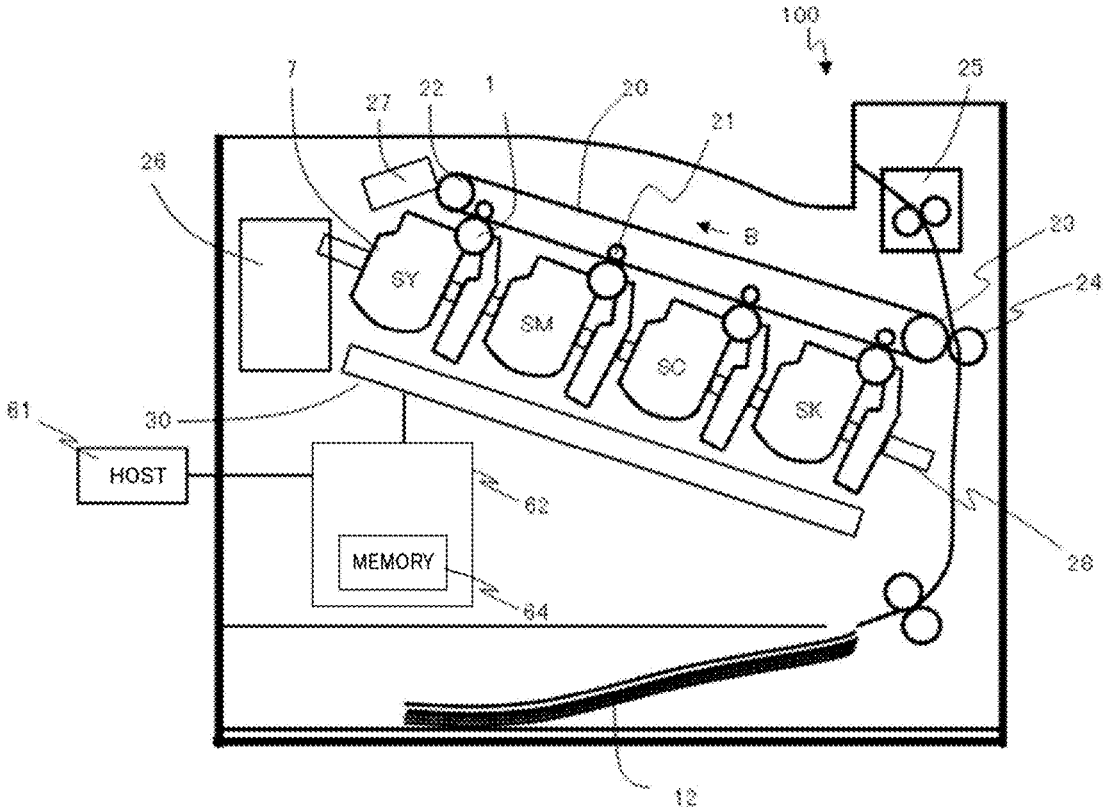
FIG. 1 is a sectional schematic configuration diagram of an image forming apparatus according to a first embodiment.

An overall configuration of an image forming apparatus will now be described. FIG. 1 is a sectional schematic configuration diagram of an image forming apparatus 100. The image forming apparatus 100 is a full-color laser printer adopting an in-line system and an intermediate transfer system. The image forming apparatus 100 forms a full-color image on a recording medium 12 (for example, recording paper, a plastic sheet, and cloth) based on image data. The image forming apparatus 100 obtains image data from a host 61 such as an image reading apparatus, a personal computer, or the like connected to the image forming apparatus 100.

The image forming apparatus 100 includes first, second, third, and fourth image forming units SY, SM, SC, and SK for respectively forming images of the colors yellow (Y), magenta (M), cyan (C), and black (K). The first to fourth image forming units SY, SM, SC, and SK are arranged in a single row in a direction intersecting a vertical direction.

Moreover, configurations and operations of the first to fourth image forming units SY, SM, SC, and SK are substantially the same with the exception of differences in colors of images formed. Therefore, hereinafter, unless the image forming units must be distinguished from one another, the image forming units may be described by omitting the characters Y, M, C, and K which represent colors.

All process cartridges 7 for the respective colors have a same shape, and toners of the respective colors of yellow (Y), magenta (M), cyan (C), and black (K) are stored in the process cartridges 7 for the respective colors.

The image forming apparatus 100 has an intermediate transfer member to which toner 10 developed by the process cartridge 7 is transferred. The intermediate transfer member is constituted by an intermediate transfer belt 20 formed of an endless belt, comes into contact with an entirety of a photosensitive drum 1 which is a rotationally driven image bearing member, and moves in a circulating manner (rotates) in a direction of an arrow B (counterclockwise in FIG. 1). The intermediate transfer belt 20 (the intermediate transfer member) is stretched over a primary transfer roller 21, a cleaning opposing roller 22, and a secondary transfer opposing roller 23.

Four primary transfer rollers 21 are arranged side by side in a rotation direction of the intermediate transfer belt 20 on a side of an inner peripheral surface of the intermediate transfer belt 20 so as to oppose each photosensitive drum 1. The primary transfer roller 21 constitutes a primary transfer unit which presses the intermediate transfer belt 20 toward the photosensitive drum 1, which brings the intermediate transfer belt 20 and the photosensitive drum 1 into contact with each other, and which transfers a toner image (a developer image) on the photosensitive drum 1 to the intermediate transfer belt 20 that is an intermediate transfer member. A bias having an opposite polarity to a normal charging polarity of toner is applied to the primary transfer roller 21 from a primary transfer bias power supply. Accordingly, the toner image on the photosensitive drum 1 is transferred onto the intermediate transfer belt 20 (primary transfer).

A secondary transfer roller 24 is arranged at a position opposing the secondary transfer opposing roller 23 on a side of an outer peripheral surface of the intermediate transfer belt 20. The secondary transfer roller 24 constitutes a secondary transfer unit which comes into pressure contact with the secondary transfer opposing roller 23 via the intermediate transfer belt 20, which brings the intermediate transfer belt 20 and the secondary transfer roller 24 into contact with each other, and which transfers a toner image (a developer image) on the intermediate transfer belt 20 to the recording medium 12. A bias having an opposite polarity to the normal charging polarity of toner is applied to the secondary transfer roller 24 from a secondary transfer bias power supply. Accordingly, the toner image on the intermediate transfer belt 20 is transferred to the recording medium 12 (secondary transfer).

A belt cleaner 27 which is a second cleaning unit for removing toner remaining on the intermediate transfer belt 20 after secondary transfer from the intermediate transfer belt 20 (hereinafter this toner may be referred to as "secondary transfer residual toner") is arranged on a side of an outer circumferential surface of the intermediate transfer belt 20 on a downstream side of the secondary transfer unit. The belt cleaner 27 is configured to clean a belt with a blade.

A fixing apparatus 25 is arranged above the secondary transfer roller 24. The fixing apparatus 25 applies heat and pressure to the recording medium 12 to which a toner image (a developer image) has been transferred to fix the toner image to the recording medium 12.

Configuration of Process Cartridge

An overall configuration of the process cartridge 7 to be mounted to the image forming apparatus 100 will be described. Configurations and operations of the process cartridges 7 of the respective colors are substantially the same with the exception of types (colors) of toners stored therein.

Figure 2:
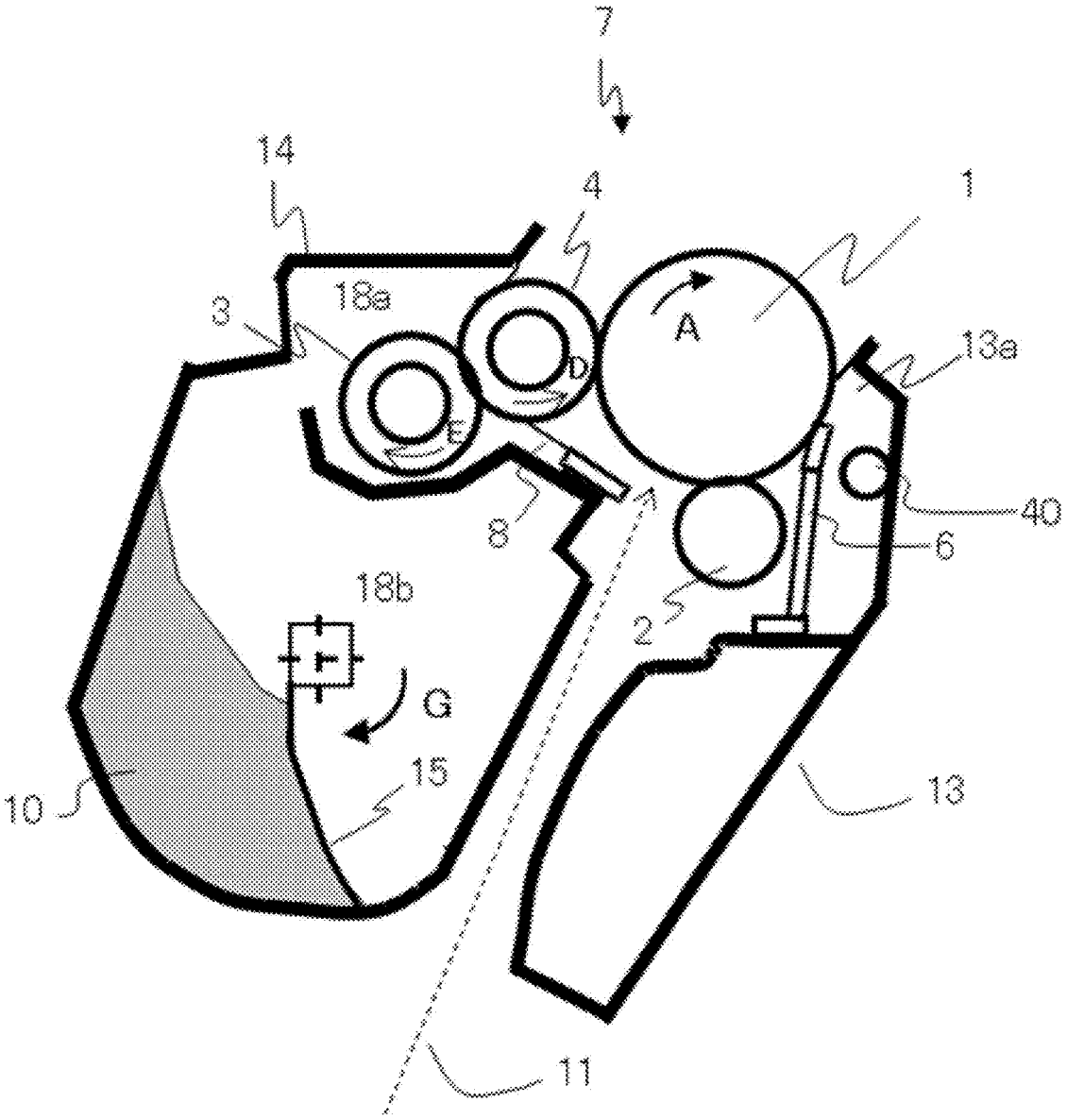
FIG. 2 is a sectional schematic configuration diagram of a developing apparatus and a process cartridge according to the first embodiment.
Figure 3:
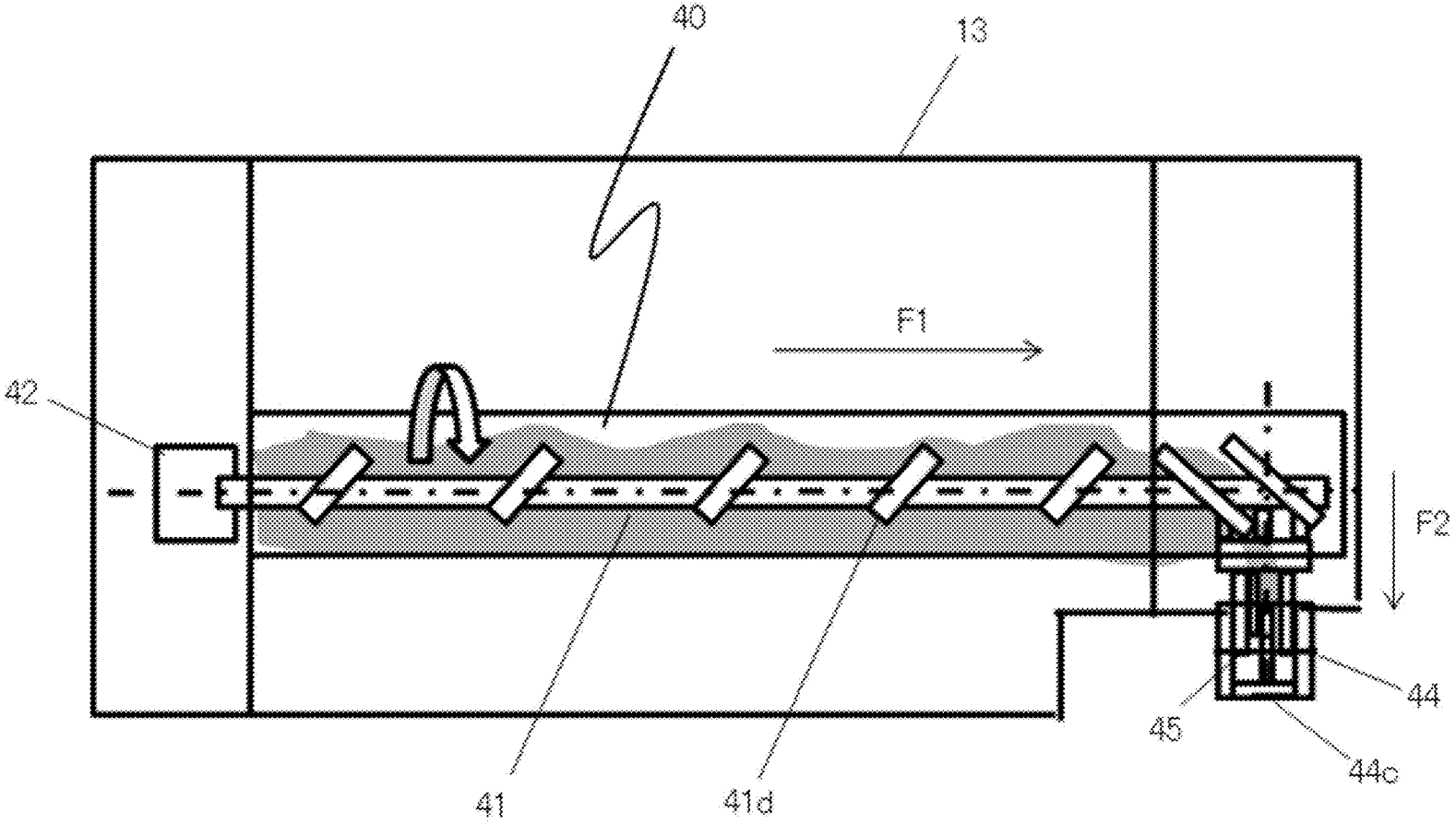
FIG. 3 is a sectional schematic configuration diagram for illustrating waste toner conveyance according to the first embodiment.
Figure 4:
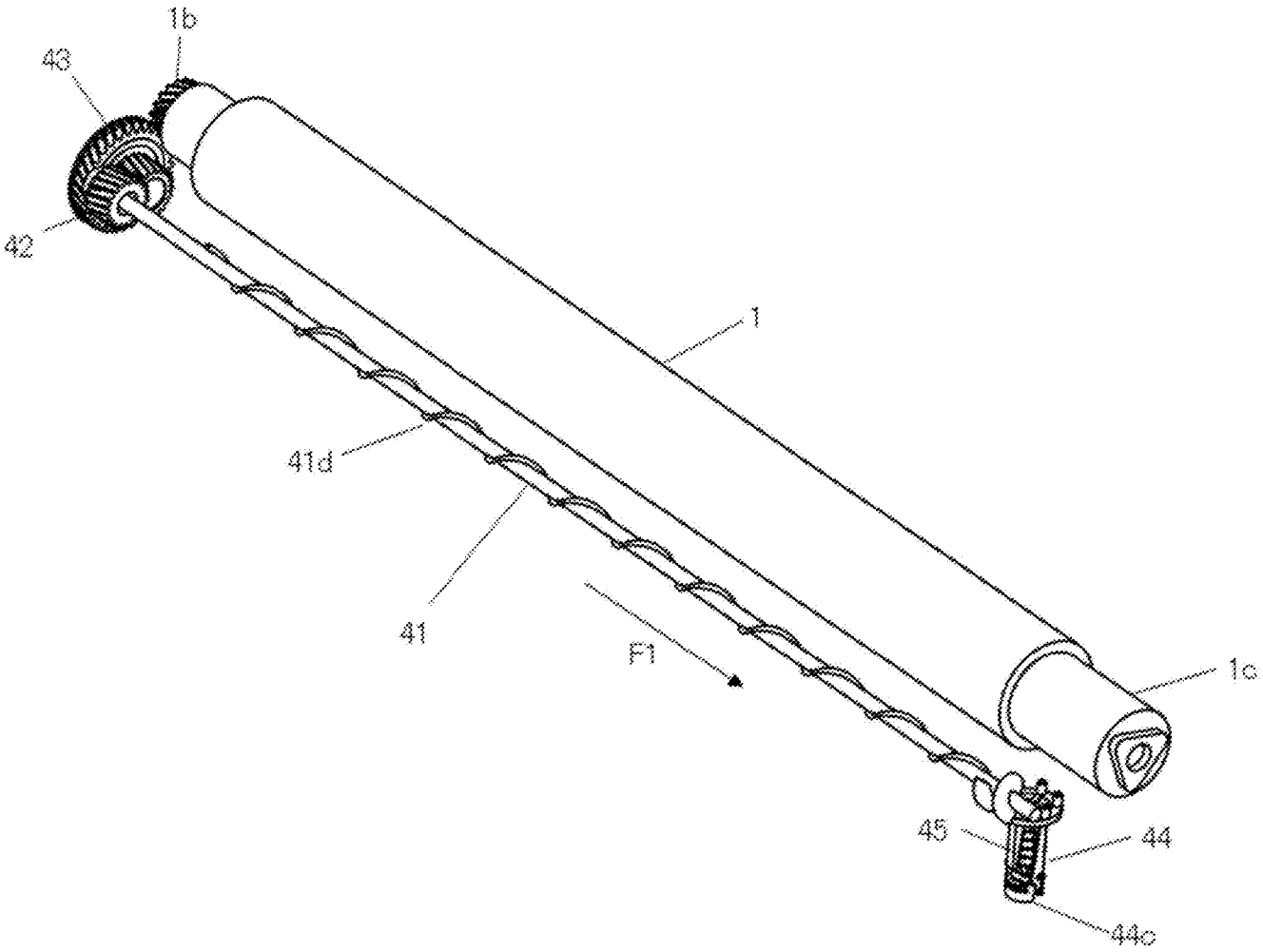
FIG. 4 is a schematic perspective view showing a drive transmission configuration of waste toner conveyance according to the first embodiment.
Figure 5:
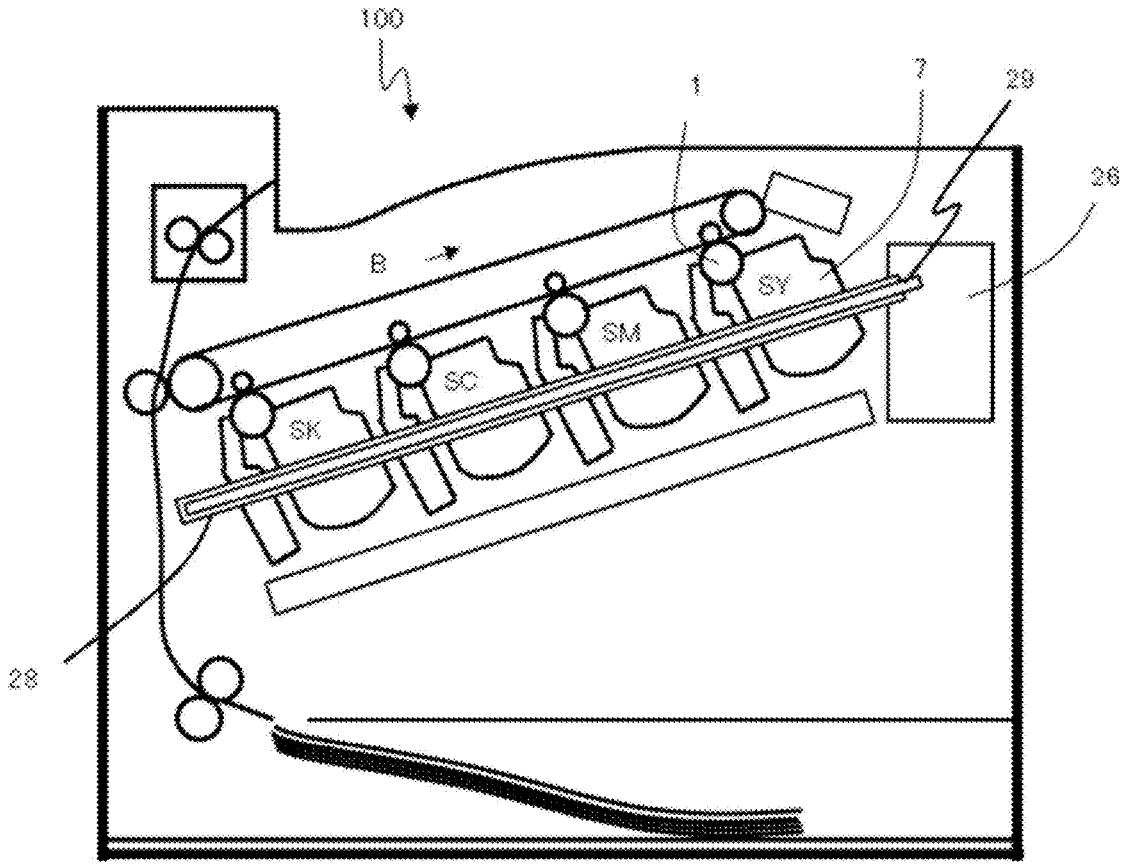
FIG. 5 is a sectional schematic configuration diagram showing a waste toner conveying path according to the first embodiment.

FIG. 2 is a schematic configuration diagram of the process cartridge 7 taken along a cross section perpendicular to a longitudinal direction (a rotational axis direction) of the photosensitive drum 1. A posture of the process cartridge 7 in FIG. 2 is a posture in a state where the process cartridge 7 is mounted to the image forming apparatus, and positional relationships, directions, and the like of the respective components of a process cartridge described below represent positional relationships, directions, and the like in this posture.

The process cartridge 7 is configured so as to integrate a photosensitive unit 13 including the photosensitive drum 1 and the like with a developing unit 14 including a developing roller 4 and the like.

The photosensitive unit 13 is a frame body to which the photosensitive drum 1 is rotatably mounted via bearings. The photosensitive drum 1 is rotationally driven in a direction of an arrow A (clockwise in FIG. 2) in accordance with an image forming operation as a drive force of a drive motor that is a drive source is transmitted to the photosensitive unit 13. The photosensitive drum 1 has an outer diameter of 24 mm and rotates at 40 rpm. Note that the size and the rotational speed of the photosensitive drum described above are merely examples and the size and the rotational speed are not limited thereto. The photosensitive drum 1 performs a central role in an image forming process of the image forming apparatus. As the photosensitive drum 1, an organic photosensitive drum is used in which an outer circumferential surface of an aluminum cylinder is sequentially coated with an undercoat layer, a carrier generation layer, and a carrier transfer layer which are functional films.

A drum cleaner 6 and a charging roller 2 are arranged in the photosensitive unit 13 so as to come into contact with an outer circumferential surface of the photosensitive drum 1.

The drum cleaner 6 is a first cleaning unit which removes, from the photosensitive drum 1, toner remaining on the surface of the photosensitive drum 1 after transfer of a toner image (a developer image) from the photosensitive drum 1 to the intermediate transfer belt 20. The toner (waste toner) removed from the surface of the photosensitive drum 1 by the drum cleaner 6 falls into a waste toner storage portion 13*a* in the photosensitive unit 13 to be stored in the waste toner storage portion 13*a*. The waste toner storage portion 13*a* is a first storage unit in which toner removed from the photosensitive drum 1 by the drum cleaner 6 is collected. In this manner, the photosensitive unit 13 constitutes a frame body which rotatably supports the photosensitive drum 1 as an image bearing member and which has the waste toner storage portion 13*a* as a storage portion for storing toner collected from the surface of the photosensitive drum 1.

The charging roller 2 is formed of a core metal and a conductive rubber portion which covers an outer circumferential surface of the core metal, and the charging roller 2 is driven to rotate as a roller in the conductive rubber portion comes into pressure contact with the photosensitive drum 1.

Prescribed DC voltage is applied to the core metal of the charging roller 2 and, accordingly, a uniform dark-part potential Vd is formed on the surface of the photosensitive drum 1. A spot pattern of laser light 11 emitted based on image data from a scanner unit 30 (refer to FIG. 1) exposes the photosensitive drum 1 and, in the exposed portion, surface charge dissipates due to a carrier from the carrier generation layer and a magnitude of potential declines. As a result, an electrostatic latent image in which an exposed portion has a prescribed light-part potential V1 and an unexposed portion has a prescribed dark-part potential Vd is formed on the surface of the photosensitive drum 1. It is assumed that the dark-part potential Vd=−500 V and the light-part potential V1=−100 V. In addition, a resolution of 600 dpi is assumed. The dark-part potential, the light-part potential, and the resolution described above are merely examples and the dark-part potential, the light-part potential, and the resolution are not limited thereto.

The developing unit 14 is a developing unit which supplies toner to the photosensitive drum 1 that is an image bearing member and which forms a toner image on the photosensitive drum 1 during an image forming period. The developing unit 14 has the developing roller 4 that is a developer bearing member which is rotationally driven and which bears the toner 10 and a developing chamber 18*a* in which a toner supplying roller 3 that supplies the toner 10 to the developing roller 4 is arranged. The developing unit 14 is provided with a toner storage chamber 18*b* below the toner supplying roller 3 in the direction of gravitational force. An agglomeration degree of the toner ranges from 5% to 40$ in an initial state. Toner with such an agglomeration degree is desirably used in order to ensure flowability of toner. The agglomeration degree of toner was measured as follows. The toner characteristics described above are merely examples and toner characteristics are not limited thereto.

As a measurement apparatus, a powder tester (manufactured by Hosokawa Micron Corporation) including a digital vibration meter (Digital Vibration Meter model 1332, manufactured by Showa Sokki Corporation) was used. As a measurement method, 390 mesh, 200 mesh, and 100 mesh sieves were stacked on a shaking table in an ascending order of mesh sizes or, in other words, in an order of sieves of 390 mesh, 200 mesh, and 100 mesh so that the 100 mesh sieve was stacked at the top.

5 g of an accurately weighed sample (toner) was placed on the set 100 mesh sieve, a value of displacement of the digital vibration meter was adjusted to 0.60 mm (peak-to-peak), and vibration was applied for 15 seconds. Subsequently, a mass of the sample remaining on each sieve was measured and an agglomeration degree was obtained based on the following equation.

The measured samples were left out in a 23° C., RH=60% environment for 24 hours in advance, and the measurement was also performed in a 23° C., RH=60% environment.

Agglomeration degree (%)=(mass of residual sample on 100 mesh sieve/5 g)×100+(mass of residual sample on 200 mesh sieve/5 g)×60+(mass of residual sample on 390 mesh sieve/5 g)×20

A nip unit which sandwiches toner is formed between the toner supplying roller 3 and the developing roller 4 that is a developer bearing member.

A stirring member 15 is provided inside the toner storage chamber 18*b*. The stirring member 15 stirs the toner stored in the toner storage chamber 18*b* and, at the same time, conveys the toner in a direction of an arrow G toward an upper part of the toner supplying roller 3. The stirring member 15 is driven so as to rotate at 30 rpm. The rotational speed of the stirring member 15 described above is merely an example and the rotational speed is not limited thereto.

A developing blade 8 is arranged below the developing roller 4 that is a developer bearing member and is in contact with the developing roller 4 in a counter direction, and regulates a coating amount of and imparts a charge to toner supplied to a surface of the developing roller 4 by the toner supplying roller 3. The developing blade 8 is constituted by a 0.1 mm-thick, leaf spring-like SUS thin plate, contact pressure is created using spring elasticity of the thin plate, and a surface of the developing blade 8 is brought into contact with the toner and the developing roller 4. The configuration of the developing blade 8 is merely an example and the configuration is not limited thereto. For example, the developing blade 8 may be constituted by a thin plate of a metal such as phosphor bronze or aluminum. The developing blade 8 may be used in which a surface thereof is coated by a thin film made of a polyamide elastomer, a urethane rubber, a urethane resin, or the like.

The toner borne on the surface of the developing roller 4 that is a developer bearing member is triboelectrically charged due to friction between the developing blade 8 and the developing roller 4 and a charge is imparted thereto and, at the same time, a layer thickness of the toner is regulated. Prescribed voltage is applied to the developing blade 8 from a blade bias power supply unit to stabilize a toner coat. It is assumed that blade bias=−500 V. Note that the blade bias described above is merely an example and the blade bias is not limited thereto.

The developing roller 4 and the photosensitive drum 1 respectively rotate so that surfaces thereof move in a same direction (a direction from bottom to top) in an opposing portion. While the developing roller 4 is arranged in contact with the photosensitive drum 1, a configuration may be adopted in which the developing roller 4 is arranged in proximity of the photosensitive drum 1 at a prescribed interval. A controller 62 has a first control mode and a second control mode as control modes of rotational drive of the photosensitive drum 1 and the developing roller 4. In the first control mode, a peripheral velocity ratio that is a ratio of a peripheral velocity of the developing roller 4 to a peripheral velocity of the photosensitive drum 1 is a first peripheral velocity ratio, and in the second control mode, the peripheral velocity ratio is a second peripheral velocity ratio that is higher than the first peripheral velocity ratio. For example, when the peripheral velocity of the photosensitive drum 1 is 300 mm/s and the peripheral velocity of the developing roller 4 is 450 mm/s, the peripheral velocity ratio is 1.5. While the higher the peripheral velocity ratio, the higher the development efficiency, the peripheral velocity ratio is set between 0 to around 0.3 in view of trade-offs such as toner scattering and deterioration of developer. For example, the controller 62 sets the peripheral velocity ratio to 1.0 in the first control mode and to 2.0 in the second control mode. The controller 62 switches between the first control mode and the second control mode in accordance with image quality settings of image formation and settings of a recording medium. Setting values of the peripheral velocity ratio and the number of control modes are not limited to the described examples. In addition, a function for variably controlling the peripheral velocity ratio is not an essential requisite for implementing the present invention.

A prescribed DC bias that is lower than the light-part potential of the photosensitive drum 1 is applied to the developing roller 4. In this case, a difference in potential ΔV=200 V is created with the light-part potential of the photosensitive drum 1 by applying V=−300 V to the developing roller 4. Toner negatively charged by triboelectric charging is only transferred to a portion of the light-part potential on the photosensitive drum 1 from the developing roller 4 in a developing unit which is in contact with the photosensitive drum 1. Accordingly, the electrostatic latent image is developed and a toner image is formed.

The toner supplying roller 3 and the developing roller 4 rotate in a direction in which respective surfaces thereof move from up to down in the nip unit. In other words, the toner supplying roller 3 rotates in a direction of an arrow E and the developing roller 4 rotates in a direction of an arrow D. The toner supplying roller 3 is an elastic sponge roller in which a foam layer is formed on an outer circumference of a conductive core metal. The toner supplying roller 3 is pressed and depresses in a contact portion with the developing roller 4. An amount of depression (a penetration level) of the toner supplying roller 3 in the contact portion is denoted by ΔH. The toner supplying roller 3 and the developing roller 4 rotate in opposite directions and, in the contact portion, toner is supplied from the toner supplying roller 3 to the developing roller 4. A toner supply amount from the toner supplying roller 3 to the developing roller 4 can be adjusted by adjusting a difference in potential between the toner supplying roller 3 and the developing roller 4. The toner supplying roller 3 is driven so as to rotate at 80 rpm and the developing roller 4 is driven so as to rotate at 100 rpm. A DC bias is respectively applied to the toner supplying roller 3 and the developing roller 4 so that the toner supplying roller 3 and the developing roller 4 share a same potential.

Outer diameters of the developing roller 4 and the toner supplying roller 3 are both 15 mm, and a penetration level (the depression amount ΔH) of the toner supplying roller 3 into the developing roller 4 is assumed to be 1.0 mm. The toner supplying roller 3 and the developing roller 4 are arranged so that respective centers thereof are at a same height.

The toner supplying roller 3 is provided with a conductive supporter and a foam layer supported by the conductive supporter. Specifically, the toner supplying roller 3 is provided with a core metal electrode with an outer diameter ϕ of 5 mm as the conductive supporter and a foam urethane layer that is a foam layer constituted by an open-cell foam in which foams are connected with one another around the core metal electrode.

Operation of Image Forming Apparatus

During an image forming period of the image forming apparatus 100, first, the surface of the photosensitive drum 1 is uniformly charged by the charging roller 2. Next, due to laser light in accordance with image data emitted from the scanner unit 30, the charged surface of the photosensitive drum 1 is subjected to scanning exposure and an electrostatic latent image in accordance with the image data is formed on the photosensitive drum 1. The electrostatic latent image formed on the photosensitive drum 1 is then developed by the developing unit 14 as a toner image. The toner image formed on the photosensitive drum 1 is transferred (primarily transferred) onto the intermediate transfer belt 20 by an action of the primary transfer roller 21.

For example, when forming a full-color image, the process described above is sequentially performed by the first to fourth image forming units SY, SM, SC, and SK, and toner images of the respective colors are primarily transferred onto the intermediate transfer belt 20 so as to be sequentially superimposed on one another.

Subsequently, the recording medium 12 is conveyed to the secondary transfer unit in synchronization with a movement of the intermediate transfer belt 20. Due to an action of the secondary transfer roller 24 in contact with the intermediate transfer belt 20, the toner images of the four colors on the intermediate transfer belt 20 are collectively secondarily transferred onto the recording medium 12.

The recording medium 12 onto which the toner images have been transferred is conveyed to the fixing apparatus 25. Heat and pressure are applied to the recording medium 12 in the fixing apparatus 25 to fix the toner images onto the recording medium 12.

Toner remaining on the photosensitive drum 1 after the primary transfer process is removed from the photosensitive drum 1 by the drum cleaner 6 and stored in the waste toner storage portion 13*a*. The toner (waste toner) stored in the waste toner storage portion 13*a* is conveyed from the process cartridge 7 to a waste toner box 26 which is a second storage unit installed in the image forming apparatus 100 that differs from the waste toner storage portion 13*a*. The waste toner box 26 is provided outside of the plurality of process cartridges 7 inside the main body of the image forming apparatus 100.

The residual toner that remains on the intermediate transfer belt 20 after the secondary transfer process is removed from the intermediate transfer belt 20 by the belt cleaner 27.

Moreover, the image forming apparatus 100 is also capable of forming a single-color or multi-color image using only a part of the four image forming units.

Conveyance of Waste Toner

A conveying unit which conveys toner stored inside each waste toner storage portion 13*a* (the first storage unit) of the plurality of process cartridges 7 to the outside waste toner box 26 (the second storage unit) in the image forming apparatus 100 will now be described with reference to FIGS. 2, 3, 4, and 5.

The photosensitive drum 1 rotates in a direction of an arrow A in FIG. 2 during image formation. Toner remaining on the surface of the photosensitive drum 1 after the primary transfer process is scraped off from the surface of the photosensitive drum 1 by a tip portion of the drum cleaner 6 and stored in the waste toner storage portion 13*a*. The waste toner storage portion 13*a* is provided with a first conveying path 40 for conveying waste toner.

The waste toner is conveyed by a first conveying member 41 installed in the first conveying path 40 in a direction of an arrow F1 toward one end side in the longitudinal direction (rotational axis direction) of the photosensitive drum 1.

The first conveying member 41 is rotatably supported by the photosensitive unit 13 as a frame body and is driven as a drive force which rotates the photosensitive drum 1 is transmitted via a first conveying member gear 42. A rotational drive force is transmitted from a main body coupling of the image forming apparatus 100 to a drive input portion 1*c* at one longitudinal end of the photosensitive drum 1. The rotational drive force is transmitted from the photosensitive drum 1 to the first conveying member 41 via a photosensitive drum gear 1*b*, an idler gear 43, and the first conveying member gear 42.

The first conveying member 41 has a helical conveying blade 41*d* which conveys waste toner in an axial direction by rotating. A second conveying path 44 is connected to a downstream-side end of the first conveying path 40 in a conveying direction (direction of F1).

Waste toner conveyed to a side of one end in the longitudinal direction of the first conveying path 40 is conveyed in a direction F2 along the second conveying path 44 by a spring-like second conveying member 45. The conveying direction F2 in the second conveying path 44 intersects or is orthogonal to the conveying direction F1 in the first conveying path 40. The second conveying member 45 has a helical shape and, by rotating, conveys the waste toner in the second conveying path 44 to a toner communication port 44*c* in an axial direction (direction of F2) while loosening the waste toner. The waste toner conveyed to the toner communication port 44*c* provided in the process cartridge 7 is discharged to a main body conveying path 28 of the image forming apparatus 100.

The waste toner discharged to the main body conveying path 28 is conveyed and discharged to the waste toner box 26 provided outside of a cartridge of the image forming apparatus 100 by a main body conveying screw 29 provided in the main body conveying path 28. The discharged waste toner is stored in the waste toner box 26. In this manner, the first conveying member 41 and the second conveying member 45 which are rotatably supported by the photosensitive unit 13 as a frame body perform a conveyance operation in which toner stored in the waste toner storage portion 13*a* is conveyed from the inside to the outside of the waste toner storage portion 13*a*.

The position at which the second conveying path 44 is arranged is not limited to an end in the longitudinal direction of the photosensitive unit 13 and may be, for example, a center in the longitudinal direction. A shape of the second conveying member 45 is not limited to a spring shape and may be, for example, a screw shape.

Waste Toner Conveyance Control

In the image forming apparatus 100, the first conveying member 41 that is a waste toner conveying member is configured to perform a conveyance operation of conveying waste toner by rotating due to a drive force transmitted from the photosensitive drum 1. An amount of waste toner conveyed by the first conveying member 41 is determined by an amount of rotations (amount of rotations (or number of rotations)=rotational speed×time) of the photosensitive drum 1. There is an upper limit to the amount of waste toner that can be conveyed by the first conveying member during image formation. In an image formation mode (for example, a high-quality mode or a high-density mode) in which a large amount of toner is used, the amount of waste toner may increase as compared to a standard image formation mode. When image formation is performed in such an image formation mode, there is a possibility that conveyance of waste toner from inside the waste toner storage portion 13*a* to the main body of the image forming apparatus 100 may fail to catch up with the increase in waste toner and an excessive amount of waste toner stored inside the waste toner storage portion 13*a* may cause problems such as clogging.

In consideration thereof, in the image forming apparatus 100 according to the first embodiment, second conveyance control is executed as appropriate in addition to first conveyance control in which waste toner is conveyed from the waste toner storage portion 13*a* to the main body of the image forming apparatus 100 due to driving of the first conveying member 41 during image formation. Second conveyance control refers to control in which, by rotationally driving the photosensitive drum 1 during a non-image forming period in which image formation is not performed, a conveying unit such as the first conveying member 41 or the second conveying member 45 is caused to perform a conveyance operation to convey waste toner in the waste toner storage portion 13*a*. The second conveyance control includes control in which the photosensitive drum 1 is rotationally driven for the purpose of causing a conveying unit to perform conveyance of waste toner. Image formation is not performed in the second conveyance control. Therefore, waste toner is not generated during the second conveyance control. In the second conveyance control, the photosensitive unit 13 is separated from the developing unit 14 and only the photosensitive unit 13 is driven for a prescribed period of time at a prescribed rotational speed. By the second conveyance control, a prescribed amount of waste toner is discharged from inside each waste toner storage portion 13*a* of the first to fourth image forming units SY, SM, SC, and SK (hereinafter, referred to as stations) to the waste toner box 26 provided outside of the cartridge. W3 denotes an amount of waste toner conveyed by the second conveyance control. The image forming apparatus 100 obtains (calculates) an amount of stored waste toner of the waste toner storage portion 13*a* during an image forming period and, when the amount of the stored waste toner is equal to or larger than a prescribed threshold, executes the second conveyance control to reduce the amount of the stored waste toner of the waste toner storage portion 13*a*. This is a case where it is determined that the amount of the stored waste toner of the waste toner storage portion 13*a* may possibly reach an upper limit. In such a case, a continuous image forming operation is temporarily stopped to execute the second conveyance control. Accordingly, even during an image forming operation in which a large amount of waste toner may be generated, the amount of the stored waste toner of the waste toner storage portion 13*a* can be prevented from becoming excessive and clogging and the like can be prevented from occurring in the waste toner storage portion 13*a*.

Waste toner conveyance control is executed by the controller 62 of the image forming apparatus 100. The controller 62 obtains a toner amount used during an image forming period based on image data, and obtains an amount of stored waste toner in the waste toner storage portion 13*a* after image formation based on the used toner amount. When the obtained amount of the stored waste toner is equal to or larger than a prescribed threshold, the controller 62 reduces the amount of the stored waste toner in the waste toner storage portion 13*a* by executing the second conveyance control which causes a conveying member to perform a conveyance operation during a non-image forming period in which image formation is not performed.

The controller 62 obtains the number of dots constituting an image from image data, obtains a toner amount used in image formation or a value corresponding to the toner amount based on the number of dots, and obtains an amount of waste toner generated due to image formation based on the used toner amount. For this calculation, toner consumption A (Ay, Am, Ac, and Ak) per dot of each station is stored in advance in a memory 64 of the image forming apparatus 100 or in a similar storage apparatus provided in the process cartridge 7. Primary transfer efficiency T (Ty, Tm, Tc, and Tk) which represents a proportion of toner transferred to the intermediate transfer belt 20 in toner on the photosensitive drum 1 in the primary transfer process is also stored in the memory 64. Retransfer efficiency R (Ry, Rm, Rc, and Rk) which represents, when primarily transferred toner on the intermediate transfer belt 20 passes the photosensitive drum 1 of a downstream station, a proportion of toner transferred to the photosensitive drum 1 is also stored in the memory 64. In this case, it is assumed that the toner consumption A per dot is 0.003 mg, the primary transfer efficiency T is 0.90, and the retransfer efficiency is 0.05. The values given above are merely examples and the constants are not limited thereto.

An amount We of waste toner conveyed by the first conveyance control during image formation is also stored in the memory 64. A drive force of the first conveying member 41 is transmitted from the photosensitive drum 1. The amount We of the waste toner conveyed by the first conveyance control is a toner amount which is conveyed from the waste toner storage portion 13*a* to the waste toner box 26 as the conveying unit is driven by a rotation of the photosensitive drum 1 during an image forming period with respect to one sheet of recording medium. In this case, the amount We of the waste toner conveyed by the first conveyance control is assumed to be 0.1 g. This value is merely an example and the constant is not limited thereto.

As constants such as the toner consumption A per dot, the primary transfer efficiency T, the retransfer efficiency R, and the amount We of the waste toner conveyed by the first conveyance control, a plurality of values may be selectively used in accordance with environmental conditions (temperature and humidity). In such a case, the plurality of constants determined in accordance with environmental conditions are to be stored in the memory 64 in advance.

Figure 6:
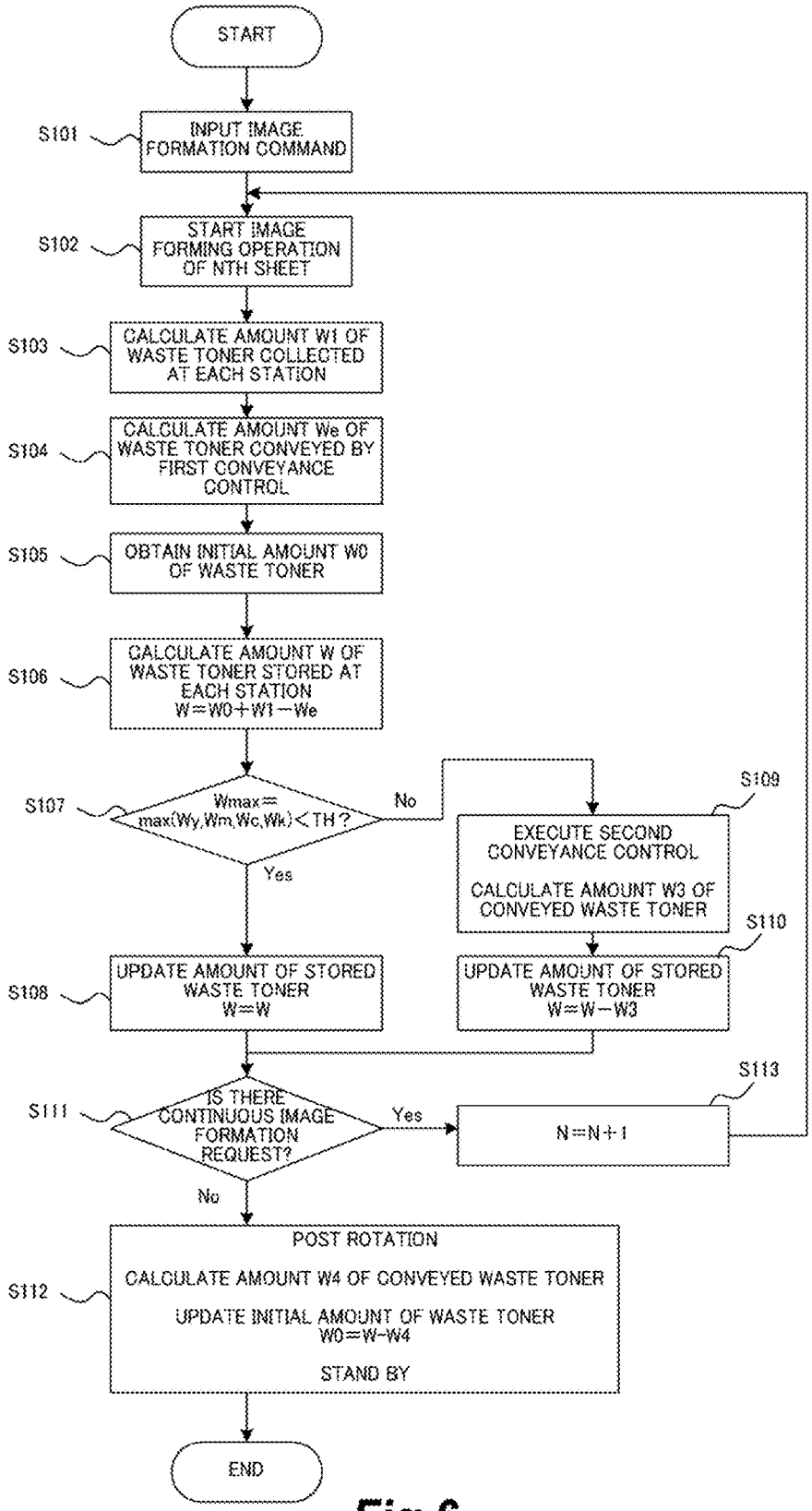
FIG. 6 is a flow chart related to a waste toner collection operation according to the first embodiment.

Conveyance control of waste toner in the image forming apparatus 100 according to the first embodiment will now be described with reference to the flow chart shown in FIG. 6. FIG. 6 is a flow chart showing a flow of waste toner conveyance control according to the first embodiment. The processes represented by the flow chart are executed by the controller 62 of the image forming apparatus 100.

In S101, the controller 62 accepts an input of an image formation command from the host 61. In this case, it is assumed that a command to form images on M-number of sheets (M≥1) of recording medium is accepted. The process of S101 includes a reception process of image data corresponding to the images to be formed on the M-number of sheets of recording medium. The controller 62 stores the received image data corresponding to the M-number of sheets in the memory 64.

In S102, the controller 62 causes the image forming apparatus 100 to start an image forming operation. This process includes rotating the developing roller 4 and an image creating process of an electrostatic latent image on the photosensitive drum 1. In this case, the controller 62 starts an image forming operation with respect to an Nth ($1 \leq N \leq M$) sheet of recording medium. The controller 62 obtains image data corresponding to an image to be formed on the Nth sheet of recording medium from the memory 64, and performs an exposure process and the like with respect to the photosensitive drum 1 based on the image data of the image to be formed on the Nth sheet of recording medium.

In S103, the controller 62 obtains an amount of waste toner generated by image formation on the Nth sheet of recording medium. Calculation processes of S103 and thereafter are executed in parallel to the image forming operation with respect to the Nth sheet of recording medium having been started in S102. Moreover, the calculation process of S103 and thereafter may be completed first, or the image forming operation with respect to the Nth sheet of recording medium may be completed first.

First, based on the image data to be formed on the Nth sheet of recording medium, the controller 62 obtains and stores, in the memory 64, the number of image dots D (Dy, Dm, Dc, and Dk) in each station. The controller 62 obtains the number of image dots D every time image data of which image formation is to be performed (in this case, image data to be formed on the Nth sheet of recording medium) is input and updates information already stored in the memory 64. The controller 62 measures a lighting time of a laser light source of the scanner unit 30 and divides the lighting time by a lighting time per dot to obtain the number of image dots D.

Based on the number of image dots D, the toner consumption A per dot, the transfer efficiency T in the primary transfer, and the retransfer efficiency R, the controller 62 obtains an amount of waste toner generated in the photosensitive unit 13 of each station in the image formation corresponding to the Nth sheet of recording medium. The amount of waste toner will be referred to as an amount W1 (W1*y*, W1*m*, W1*c*, and W1*k*) of collected waste toner. The amount W1 of the collected waste toner is an amount of the toner collected in the waste toner storage portion 13*a* during an image forming period with respect to the Nth sheet of recording medium.

The amount W1*c* of the collected waste toner in a C station will now be considered. There are two stations, namely, a Y station and an M station on an upstream side of the C station. Therefore, waste toner collected in the C station includes waste toner generated by retransfer in addition to primary transfer residual toner in the C station. Waste toner due to retransfer in the C station is waste toner that is generated by retransfer of Y toner and M toner having already been transferred onto the intermediate transfer belt 20 when passing the C station. A retransfer amount of the M toner in the C station may be obtained by multiplying, by a retransfer efficiency Rc, the toner amount primarily transferred onto the intermediate transfer belt 20 in the M station. A retransfer amount of the Y toner in the C station may be obtained by multiplying, by the retransfer efficiency Rc, the toner amount remaining on the intermediate transfer belt 20 without being retransferred in the M station after being primarily transferred onto the intermediate transfer belt 20 in the Y station. However, precisely calculating a toner amount reduced from the surface of the intermediate transfer belt 20 by retransfer when passing a station increases a calculation load on the controller 62. Therefore, in the first embodiment, regardless of which station a retransfer amount is obtained for, a toner amount that is reduced from the intermediate transfer belt 20 due to retransfer in a station on an upstream side of the station is ignored. In other words, the controller 62 obtains a retransfer amount in each station as a value calculated by multiplying the toner amount transferred onto the intermediate transfer belt 20 in primary transfer by the retransfer efficiency R.

Therefore, the amount W1 (W1*y*, W1*m*, W1*c*, and W1*k*) of the collected waste toner in the photosensitive unit 13 of each of the first to fourth stations is obtained by the following equations.

$$W1y = Ay \times Dy \times (1 - Ty)$$

$$W1m = Am \times Dm \times (1 - Tm) + Rm \times (Ay \times Dy \times Ty)$$

$$W1c = Ac \times Dc \times (1 - Tc) + Rc \times (Ay \times Dy \times Ty + Am \times Dm \times Tm)$$

$$W1k = Ak \times Dk \times (1 - Tk) + Rk \times (Ay \times Dy \times Ty + Am \times Dm \times Tm + Ac \times Dc \times Tc)$$

In S104, the controller 62 obtains an amount We of waste toner conveyed to the main body of the image forming apparatus 100 by the first conveyance control. The amount We of the waste toner conveyed by the first conveyance control that is performed during an image forming operation with respect to one sheet of recording medium is assumed to be a constant value. The amount We of the waste toner conveyed by the first conveyance control is stored in the memory 64. The controller 62 obtains a value (in the first embodiment, 0.1 g) of the amount We of the waste toner conveyed by the first conveyance control from the memory 64.

In S105, the controller 62 obtains an amount W0 (W0*y*, W0*m*, W0*c*, and W0*k*) of waste toner already stored in the waste toner storage portion 13*a* of each station by the end of a previous image formation. This amount of waste toner may hereinafter be referred to as an initial amount of waste toner. In this case, "the end of a previous image formation" means either a state where image formation on the Nth sheet of recording medium can be started or the start of image formation on the Nth sheet of recording medium after an image forming operation with respect to an N-1th sheet of recording medium has been performed and, when necessary, conveyance of waste toner by the second conveyance control has been performed. As the initial amount W0 of waste toner, the controller 62 uses the amount W (Wy, Wm, Wc, and Wk) of the stored waste toner of each station obtained during the previous image forming period. The controller 62 stores, in the memory 64, the amount W of the stored waste toner of each station obtained during the image forming period as the initial amount W0 of waste toner to be used during a next image forming period. The controller 62 reads and obtains the initial amount W0 of waste toner stored in this manner from the memory 64.

In S106, the controller 62 obtains an amount W of stored waste toner in the waste toner storage portion 13*a* of each station after the image forming operation of the Nth sheet. The amount W of the stored waste toner of the waste toner storage portion 13*a* is obtained by the following equation. This calculation formula is common to all stations.

$$W = W0 + W1 - We$$

W1: amount of the collected waste toner of each station during image forming period of Nth sheet (S103)

We: amount of the waste toner conveyed by first conveyance control performed during image forming operation of Nth sheet (S104)

W0: initial amount of waste toner (S105)

In S107, the controller 62 compares a maximum value Wmax among the amounts W (Wy, Wm, Wc, and Wk) of the stored waste toner of the respective stations obtained in S106 with a threshold TH. The threshold TH is a threshold for determining whether or not the amount of the stored waste toner has reached an upper limit of the waste toner storage portion 13*a*. When the maximum value Wmax is smaller than the threshold TH, the controller 62 advances to S108, but when the maximum value Wmax is equal to or larger than the threshold TH, the controller 62 advances to S109.

In S108, the controller 62 stores the amount W of the stored waste toner (Wy, Wm, Wc, and Wk) of the waste toner storage portion 13*a* of each station obtained in S106 in the memory 64, and updates information on the amount of the stored waste toner which has already been stored.

In S109, the controller 62 temporarily stops the continuous image forming operation and executes the second conveyance control. The controller 62 executes the process of S109 after image formation on the Nth sheet of recording medium is finished. Therefore, "temporarily stopping the continuous image forming operation" means that, after the end of the image forming operation of the Nth sheet of recording medium, a subsequent image forming operation of an N+1th sheet of recording medium is not started at once. In the second conveyance control, a situation where waste toner is not generated is created and only an operation of discharging waste toner in the waste toner storage portion 13*a* is executed. Specifically, the photosensitive unit 13 is separated from the developing unit 14 and only the photosensitive unit 13 is driven for a prescribed period of time at a prescribed speed. If an amount of waste toner conveyed by the second conveyance control is denoted by W3, the amount W of the stored waste toner of the waste toner storage portion 13*a* of each station is reduced by W3. Accordingly, since the amount W of the stored waste toner of the waste toner storage portion 13*a* of each station decreases, an occurrence of a problem such as clogging of waste toner in the waste toner storage portion 13*a* or a conveying path can be suppressed.

In the first embodiment, the amount W3 of the waste toner conveyed by the second conveyance control is set to twice the amount We of the waste toner conveyed by the first conveyance control (W3=2×We). A drive time of the photosensitive drum 1 in the second conveyance control is determined by the rotational speed of the photosensitive drum 1 in the second conveyance control and the amount We of the waste toner conveyed by the second conveyance control. Note that the set value of the amount W3 of the waste toner conveyed by the second conveyance control described above is an example and the amount W3 of the conveyed waste toner is not limited thereto. The amount W3 of the conveyed waste toner can be adjusted by adjusting the rotational speed or a drive time of the photosensitive unit 13 in the second conveyance control. For example, W3 may be set to an appropriate value based on a difference between the maximum value Wmax of the amount of the stored waste toner and the threshold TH so that executing the second conveyance control causes the amount W of the stored waste toner of the waste toner storage portion 13*a* of each station to become smaller than the threshold TH. For example, control may be performed such that, the larger the maximum value Wmax of the amount of the stored waste toner, the longer the drive time of the photosensitive drum 1 by the second conveyance control.

In S110, the controller 62 obtains a value (W−W3) by subtracting the amount W3 of the waste toner conveyed by the second conveyance control from the amount W of the stored waste toner obtained in S106. The controller 62 stores the obtained value as the amount W of the stored waste toner of the waste toner storage portion 13*a* of each station in the memory 64, and updates information on the amount of the stored waste toner.

In S111, the controller 62 checks whether or not a continuous image formation request has been made. At this point, the controller 62 determines whether or not N<M. When N<M, the controller 62 determines that a continuous image formation request has been made, advances to S113 and increments N, and returns to S102. When a continuous image formation request has not been made, the controller 62 advances to S112. At this point, when N≥M, the controller 62 determines that a continuous image formation request has not been made (image formation of all recording mediums related to the continuous image formation request has been finished).

In S112, the controller 62 executes preparatory rotation control (hereinafter, referred to as post rotation) of the photosensitive drum 1 in preparation of an input of a next image formation command after image formation. The controller 62 obtains an amount W4 of conveyed waste toner due to the first conveying member 41 being driven by a rotation of the photosensitive drum 1 in accordance with the post-rotation, and obtains a value (W−W4) by subtracting the amount W4 of the conveyed waste toner from the amount W of the stored waste toner obtained in S108 or S110. The controller 62 stores the obtained value as the initial amount W0 of waste toner stored in the waste toner storage portion 13*a* of each station in the memory 64, and updates information on the initial amount of waste toner. The controller 62 ends the image forming operation and causes a transition to be made to an image forming operation stand-by state.

According to the waste toner conveyance control shown in the flow chart, during execution of continuous image formation on a plurality of sheets of recording medium, an amount of stored waste toner of the waste toner storage portion 13*a* is obtained every time image formation on one sheet of recording medium is performed. In addition, when the amount of the stored waste toner equals or exceeds a threshold, the amount of the stored waste toner can be reduced by temporarily stopping the continuous image formation and executing second conveyance control. Moreover, while the flow chart represents an example in which a determination on whether or not the second conveyance control is to be executed is made after starting an image forming operation of one sheet (between sheets), this is simply an example and the manner in which the determination is made is not limited thereto. For example, whether or not the second conveyance control is to be executed may be determined before starting an image forming operation of one sheet, and the second conveyance control may be executed as necessary. Specifically, in the flow chart shown in FIG. 6, image data of which image formation is to be performed on the Nth sheet of recording medium is obtained in S102, and after executing the processes of S103 to S110 based on the image data, an image forming operation based on the image data may be started. In this case, the controller 62 calculates the amount W of the stored waste toner of each station after image formation on the Nth sheet of recording medium before actually performing the image formation. When the calculated amount W of the stored waste toner exceeds the threshold, the controller 62 performs the second conveyance control before actually performing the image formation to reduce the amount of the stored waste toner in advance. Therefore, even though there may be cases where a slightly longer period of time is required until the image formation on the Nth sheet of recording medium is executed, clogging, spilling, or the like of waste toner can be more reliably suppressed. Moreover, in the order of processes of the flow chart shown in FIG. 6, the processes of S103 to S110 are performed after starting the image formation of the Nth sheet of recording medium. Therefore, when it is determined in S107 that the maximum value Wmax of the amount of the stored waste toner is equal to or greater than the threshold TH, the amount of the stored waste toner of any of the stations is to actually equal or exceed the threshold. In order to prevent clogging, spilling, or the like of waste toner from occurring in such a case, the threshold TH is favorably set to a value that contains a margin. Alternatively, whether or not the second conveyance control is to be executed may be determined during a preparatory rotation of the photosensitive drum 1 before image formation or during a post-rotation of the photosensitive drum 1.

According to the image forming apparatus in the first embodiment, an amount of stored waste toner of the waste toner storage portion 13*a* is obtained from image data related to image formation and, when the amount of the stored waste toner is equal to or greater than a threshold, the second conveyance control is executed. Accordingly, the amount of the stored waste toner of the waste toner storage portion 13*a* can be prevented from becoming excessive and clogging and the like of waste toner can be prevented from occurring in the waste toner storage portion 13*a*. Moreover, the controller 62 may perform the second conveyance control when the second mode is set as a control mode of rotational drive of the photosensitive drum 1 and the developing roller 4. Since peripheral velocity is higher in the second mode than in the first mode, a large toner amount is supplied to the photosensitive drum 1 by the developing roller 4 and, accordingly, a larger amount of waste toner is generated. Performing the second conveyance control when control is being applied by the second mode enables an occurrence of clogging, spilling, or the like of waste toner to be suppressed even when an amount of generated waste toner is large.

Second Embodiment

A second embodiment will now be described. Moreover, a description of configurations with contents that are similar to those of the first embodiment will be omitted as appropriate.

The image forming apparatus 100 has the belt cleaner 27 which is a second cleaning unit for removing residual toner remaining on the intermediate transfer belt 20 after a secondary transfer process from the intermediate transfer belt 20. The belt cleaner 27 according to the second embodiment uniformly charges the residual toner on the intermediate transfer belt 20 after the secondary transfer process with a reverse polarity (a reverse polarity to a normal charging polarity) with respect to the photosensitive drum 1 of the primary transfer unit and, at the same time, guides the residual toner after the secondary transfer to the primary transfer unit. The residual toner after the secondary transfer is reverse-transferred to the photosensitive drum 1 in the primary transfer unit to remove the residual toner after the secondary transfer from the intermediate transfer belt 20. The waste toner storage portion 13*a* is configured to also collect the residual toner after the secondary transfer removed from the intermediate transfer belt 20.

A feature of the image forming apparatus 100 is that waste toner conveyance control is performed by also taking into consideration an increase in an amount of stored waste toner due to the residual toner after the secondary transfer removed from the intermediate transfer belt 20 by the belt cleaner 27 being also collected by the waste toner storage portion 13*a*.

Figure 7:
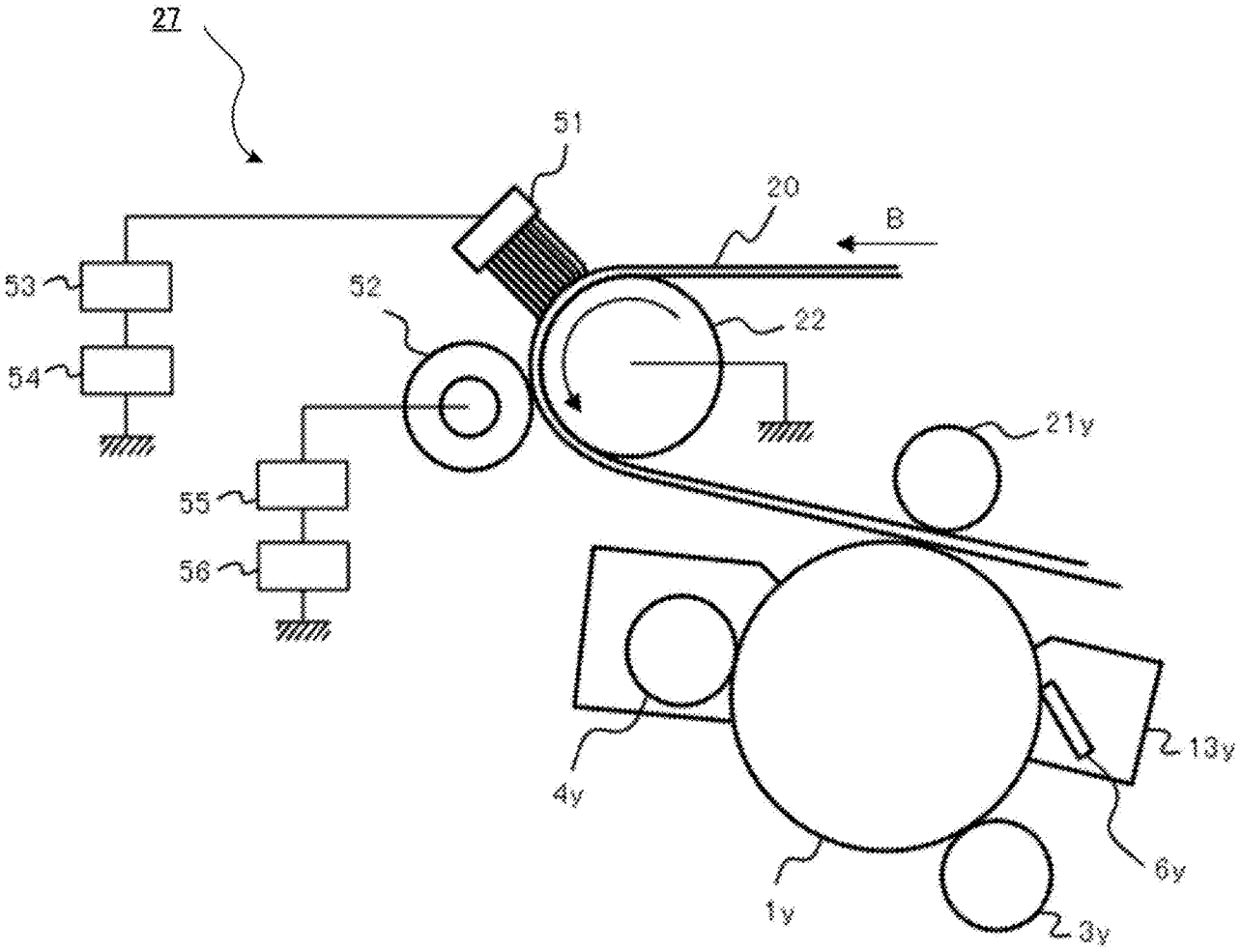
FIG. 7 is a sectional schematic configuration diagram for illustrating an intermediate transfer belt cleaning mechanism according to a second embodiment.

The belt cleaner 27 will be described with reference to FIG. 7. The belt cleaner 27 has a conductive brush 51 and a toner charging roller 52 which are charging units for charging the residual toner after the secondary transfer. The conductive brush 51 and the toner charging roller 52 are positioned on a downstream side of the secondary transfer unit and an upstream side of the primary transfer unit in a direction of travel (a direction of an arrow B) of the intermediate transfer belt 20. The conductive brush 51 is positioned on an upstream side of the toner charging roller 52. The toner charging roller 52 is in contact with the intermediate transfer belt 20 and is pressed to the cleaning opposing roller 22 with pressure of 9.8 N.

Moreover, a fixed and arranged foam sponge-like member (for example, a member formed of urethane rubber or NBR hydrin rubber), a rotatable fur brush roller, a rotatable foam sponge roller, or the like may be used in place of the conductive brush 51.

The conductive brush 51 is electrically connected to a high-voltage power supply 54 via a current detection unit 53 and biases with a positive polarity and a negative polarity can be selectively applied thereto. The toner charging roller 52 is also electrically connected to a high-voltage power supply 56 via a current detection unit 55 and biases with a positive polarity and a negative polarity can be selectively applied thereto.

During a belt cleaning operation, DC voltage with a positive polarity is respectively applied from the high-voltage power supplies 54 and 56 to the conductive brush 51 and the toner charging roller 52. The applied DC voltage is subjected to constant-current control so that current values detected by the current detection units 53 and 55 equal target current values set in advance. The target current values are set so as not to excessively charge the residual toner after the secondary transfer and, at the same time, to prevent insufficient cleaning due to insufficient charging. In this case, the target current value of the conductive brush 51 is set to 20 μA and the target current value of the toner charging roller 52 is set to 30 μA.

During a belt cleaning operation, applying a positive bias to the conductive brush 51 causes a positive electric field to be formed from the conductive brush 51 toward the intermediate transfer belt 20 and causes toner charged with a negative polarity in the residual toner after the secondary transfer to electrostatically be trapped in the conductive brush 51. Accordingly, an amount of the residual toner after the secondary transfer which passes the toner charging roller 52 during the belt cleaning operation is reduced. Applying a positive bias to the conductive brush 51 also produces a pre-charging effect of charging toner with a positive polarity due to a discharge between the conductive brush 51 and the residual toner after the secondary transfer.

At the toner charging roller 52, the residual toner after the secondary transfer having passed the conductive brush 51 is uniformly charged with a positive polarity by a discharge due to a difference in potential with respect to the intermediate transfer belt 20.

When the residual toner after the secondary transfer charged with a positive polarity passes a first station on a downstream side of the toner charging roller 52, a positive bias V5 is applied to the primary transfer roller 21*y* in the first station. Accordingly, a toner image with a negative polarity which is developed on the photosensitive drum 1*y* is primarily transferred to the intermediate transfer belt 20 and, at the same time, the residual toner after the secondary transfer with a positive polarity is reverse-transferred from the intermediate transfer belt 20 to the photosensitive drum 1*y*. The residual toner after the secondary transfer reverse-transferred to the photosensitive drum 1 is subsequently collected by the drum cleaner 6*y* of the photosensitive unit 13*y* and stored in the waste toner storage portion 13*a*.

The positive bias V5 applied to the primary transfer roller 21*y* is set to a value which maximizes the primary transfer efficiency T. In the second embodiment, V5 is set to +600 V in a 23° C., RH=50% environment. The positive bias V5 applied to the primary transfer roller 21*y* is favorably set to an optimum value in accordance with environmental conditions. Note that the value of the positive bias V5 applied to the primary transfer roller 21 described above is merely an example and the value is not limited thereto.

As described above, in the belt cleaner 27, the residual toner after the secondary transfer is removed from the intermediate transfer belt 20 as a part of the residual toner after the secondary transfer is trapped in the conductive brush 51. In addition, the residual toner after the secondary transfer is pre-charged at the conductive brush 51 and uniformly charged with a positive polarity at the downstream toner charging roller 52. The residual toner after the secondary transfer charged with a positive polarity is collected by the primary transfer unit and removed from the intermediate transfer belt 20.

In the image forming apparatus according to the second embodiment, the residual toner after the secondary transfer that remains on the intermediate transfer belt 20 is also collected by the photosensitive unit 13 of the process cartridge 7. Therefore, whether or not second conveyance control is to be executed is determined by also taking into consideration an increase in an amount of stored waste toner due to the collection of the residual toner after the secondary transfer.

A secondary transfer efficiency S and a belt cleaning efficiency I are used to obtain an incremental amount of the amount of the stored waste toner due to the collection of the residual toner after the secondary transfer. The secondary transfer efficiency S represents a proportion of an amount of toner transferred from the intermediate transfer belt 20 to the recording medium 12 by secondary transfer. The belt cleaning efficiency I represents a proportion of the residual toner after the secondary transfer charged with a positive polarity being reverse-transferred to the photosensitive drum 1 when passing the photosensitive unit 13. In the image forming apparatus 100 according to the second embodiment, the secondary transfer efficiency S and the belt cleaning efficiency I are stored in advance in the memory 64 or a similar storage apparatus provided in the process cartridge together with the various constants described in the first embodiment. In this case, it is assumed that the secondary transfer efficiency S is 0.9 and the belt cleaning efficiency I is 0.2. As the values of the secondary transfer efficiency S and the belt cleaning efficiency I, a plurality of values may be selectively used in accordance with environmental conditions (temperature and humidity). In such a case, the plurality of constants determined in accordance with environmental conditions are to be stored in the memory 64.

Since a positive bias is applied to the primary transfer roller 21 and collection of the residual toner after the secondary transfer is performed concurrently with a primary transfer process, the residual toner after the secondary transfer is collected at the most upstream first (Y) station during continuous image formation. Therefore, an amount of stored waste toner of the Y station is expected to be larger than the amounts of the stored waste toner of the other stations. In consideration thereof, whether or not second conveyance control is to be executed is determined based on the amount of the stored waste toner of the first (Y) station.

Figure 8:
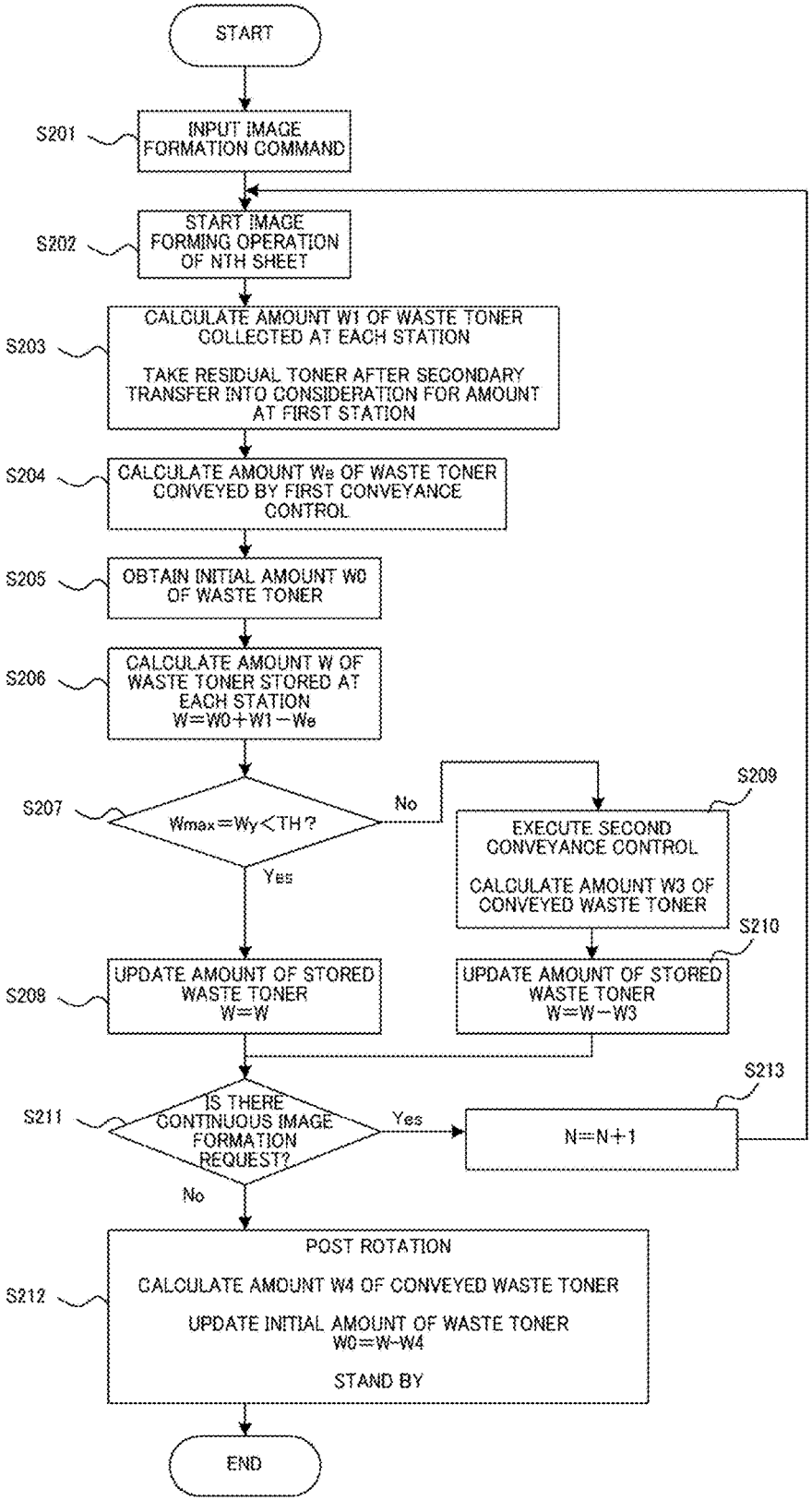
FIG. 8 is a flow chart related to a waste toner collection operation according to the second embodiment.

Conveyance control of waste toner in the image forming apparatus 100 according to the second embodiment will now be described with reference to the flow chart shown in FIG. 8. FIG. 8 is a flow chart showing a flow of waste toner conveyance control of the second embodiment. The processes represented by the flow chart are executed by the controller 62 of the image forming apparatus 100.

In S201, the controller 62 accepts an input of an image formation command from the host 61. This process is similar to S101 in the first embodiment.

In S202, the controller 62 causes the image forming apparatus 100 to start an image forming operation with respect to the Nth sheet of recording medium. This process is similar to S102 in the first embodiment.

In S203, the controller 62 obtains an amount of waste toner generated by image formation on the Nth sheet of recording medium. The calculation of the amount W1 (W1*m*, W1*c*, and W1*k*) of the collected waste toner in the second (M) to fourth (K) stations is similar to the calculation in S103 of the first embodiment. The calculation of the amount W1*y* of the collected waste toner in the most upstream first (Y) station will now be described. Based on the image data to be formed on the Nth sheet of recording medium, the controller 62 obtains and stores, in the memory 64, the number of image dots Dy in the Y station. Based on the number of image dots Dy, the toner consumption Ay per dot, the transfer efficiency Ty in the primary transfer, the secondary transfer efficiency S, and the belt cleaning efficiency I, the controller 62 obtains the amount W1*y* of the collected waste toner in the photosensitive unit 13 of the Y station. In a similar manner to the first embodiment, when calculating the amount of the collected waste toner in a given station, the calculation is performed in view of the fact that a part of toner primarily transferred to the intermediate transfer belt 20 at stations on an upstream side of the given station is retransferred to the photosensitive drum 1. However, in order to reduce a calculation load on the controller 62, it is assumed that toner on the intermediate transfer belt 20 does not decrease due to retransfer. In other words, while an increase in the amount of the collected waste toner of the waste toner storage portion 13*a* due to retransfer is taken into consideration, a decrease in toner from the intermediate transfer belt 20 due to retransfer is not considered. Therefore, the amount of the collected waste toner of the waste toner storage portion 13*a* attributable to retransfer is to be calculated slightly larger than an actual amount. The amount of the residual toner after the secondary transfer is calculated based on a toner amount obtained by adding up the toner amounts primarily transferred to the intermediate transfer belt 20 at the respective stations and on the secondary transfer efficiency S.

The amount W1*y* of the collected waste toner in the photosensitive unit 13 of the Y station is obtained by the following equation. Moreover, the equations used to obtain the amounts of the collected waste toner of the other stations are similar to those used in the first embodiment.

$$W1y=Ay\times Dy\times(1-Ty)+I\times(1-S)\times(Ay\times Dy\times Ty+Am\times Dm\times Tm+Ac\times Dc\times Tc+Ak\times Dk\times Tk)$$

In S204, the controller 62 obtains an amount We of waste toner conveyed to the main body of the image forming apparatus 100 by the first conveyance control. This process is similar to S104 in the first embodiment.

In S205, the controller 62 obtains the initial amount W0 of waste toner. This process is similar to S105 in the first embodiment.

In S206, the controller 62 obtains an amount W of the stored waste toner in the waste toner storage portion 13*a* of each station after the image forming operation of the Nth sheet. This process is similar to S106 in the first embodiment.

In S207, the controller 62 compares the amount Wy of the stored waste toner of the first (Y) station among the amounts W (Wy, Wm, Wc, and Wk) of the stored waste toner of the respective stations obtained in S206 with the threshold TH. When Wy is smaller than the threshold TH, the controller 62 advances to S208, but when Wy is equal to or larger than the threshold TH, the controller 62 advances to S209.

In S208, the controller 62 stores the amount W (Wy, Wm, Wc, and Wk) of the stored waste toner of each station obtained in S206 in the memory 64, and updates information on the amount of the stored waste toner which has already been stored.

In S209, the controller 62 temporarily stops the continuous image forming operation and executes the second conveyance control. If an amount of waste toner conveyed by the second conveyance control is denoted by W3, the amount W of the stored waste toner of the waste toner storage portion 13*a* of each station is reduced by W3. Accordingly, since the amount W of the stored waste toner of the waste toner storage portion 13*a* of each station decreases, an occurrence of a problem such as clogging of waste toner in the waste toner storage portion 13*a* or a conveying path can be suppressed. Details of the second conveyance control are similar to those of the first embodiment. W3 may be set to an appropriate value based on a difference between the maximum value Wmax of the amount of the stored waste toner and the threshold TH so that executing the second conveyance control causes the amount W of the stored waste toner of the waste toner storage portion 13*a* of each station to become smaller than the threshold TH.

In S210, the controller 62 obtains a value (W−W3) by subtracting the amount W3 of the waste toner conveyed by the second conveyance control from the amount W of the stored waste toner obtained in S206, and updates information on the amount of the stored waste toner in the memory 64. This process is similar to S110 in the first embodiment.

In S211, the controller 62 checks whether or not a continuous image formation request has been made. At this point, the controller 62 determines whether or not N<M. When N<M, the controller 62 determines that a continuous image formation request has been made, advances to S213 and increments N, and returns to S202. When a continuous image formation request has not been made, the controller 62 advances to S212. At this point, when N≥M, the controller 62 determines that a continuous image formation request has not been made (image formation of all recording mediums related to the continuous image formation request has been finished).

In S212, the controller 62 executes post-rotation after the end of image formation, obtains an amount W4 of conveyed waste toner due to the post-rotation, and obtains a value (W−W4) by subtracting the amount W4 of the conveyed waste toner from the amount W of the stored waste toner obtained in S208 or S210. The controller 62 stores the obtained value as the initial amount W0 of waste toner stored in the waste toner storage portion 13*a* of each station in the memory 64, and updates information on the initial amount of waste toner. The controller 62 ends the image forming operation and causes a transition to be made to an image forming operation stand-by state. This process is similar to S112 in the first embodiment.

Moreover, in a similar manner to the first embodiment, the determination on whether or not the second conveyance control is to be executed may be made not only between papers during continuous image formation but may also be made during preparatory rotation before starting image formation or during post-rotation. In addition, an example has been described in which whether or not second conveyance control is to be executed is determined by comparing the amount Wy of the stored waste toner of the first (Y) station which performs collection of the residual toner after the secondary transfer with the threshold TH. However, in a similar manner to the first embodiment, the maximum value Wmax among the amounts of the stored waste toner of all stations may be compared with the threshold TH.

According to the image forming apparatus in the second embodiment, even with a configuration in which the residual toner after the secondary transfer is collected by the photosensitive unit 13 of the process cartridge 7, an amount of stored waste toner of the waste toner storage portion 13*a* is obtained and, when the amount of the stored waste toner is equal to or greater than a threshold, the second conveyance control is executed. As a result, the amount of the stored waste toner of the waste toner storage portion 13*a* can be prevented from becoming excessive and clogging and the like can be prevented from occurring in the waste toner storage portion 13*a*.

Third Embodiment

A third embodiment will now be described. Moreover, a description of configurations with contents that are similar to those of the first and second embodiments will be omitted as appropriate.

In the third embodiment, an ejection process is performed in which the residual toner after the secondary transfer trapped in the conductive brush 51 and the residual toner after the secondary transfer trapped in the surface of the toner charging roller 52 are transferred to the intermediate transfer belt 20 in the configuration of the image forming apparatus according to the second embodiment.

By performing the ejection process, since the residual toner after the secondary transfer which is trapped in the conductive brush 51 and the toner charging roller 52 and which is charged with a negative polarity is transferred to the intermediate transfer belt 20, toner stored on the conductive brush 51 and the toner charging roller 52 is removed. Therefore, regularly performing the ejection process enables a decline in a cleaning effect by the belt cleaner 27 to be suppressed. The ejection process is executed at timing where an image forming operation is not performed (during a non-image forming period).

A feature of the image forming apparatus 100 according to the third embodiment is that waste toner conveyance control is performed by also taking into consideration an increase in an amount of stored waste toner due to toner ejected to the intermediate transfer belt 20 by the ejection process being collected by the waste toner storage portion 13*a*.

The ejection process will be described with reference to FIG. 7. During an image forming operation, a positive bias is applied to the conductive brush 51 by the belt cleaner 27 and a positive electric field is formed with respect to the intermediate transfer belt 20. Accordingly, a part of the residual toner after the secondary transfer with a negative polarity on the intermediate transfer belt 20 is trapped in and is held by the conductive brush 51. As the amount of toner held by the conductive brush 51 increases, since toner is less likely to newly be trapped in the conductive brush 51, the cleaning effect of the belt cleaner 27 declines.

Since performing the ejection process causes toner held by the conductive brush 51 to be transferred (ejected) to the intermediate transfer belt 20, the amount of toner held by the conductive brush 51 decreases. Accordingly, a decline in the cleaning effect by the belt cleaner 27 can be suppressed.

Since a positive bias is applied to the toner charging roller 52 in a belt cleaning process by the belt cleaner 27, a part of the residual toner after the secondary transfer with a negative polarity on the intermediate transfer belt 20 is charged with a positive polarity once past the toner charging roller 52. In addition, a part of the residual toner after the secondary transfer with a negative polarity on the intermediate transfer belt 20 is trapped in the toner charging roller 52 while retaining the negative polarity due to an electrostatic attractive force created by the positive electric field formed from the toner charging roller 52 toward the intermediate transfer belt 20.

As the amount of trapped toner on the surface of the toner charging roller 52 increases, charging performance of the toner charging roller 52 becomes unstable and a cleaning effect declines.

In consideration thereof, an ejection process in which the trapped toner on the surface of the toner charging roller 52 is transferred to the intermediate transfer belt 20 is also regularly performed at the toner charging roller 52 to prevent a decline in the cleaning effect.

The ejection process is executed at timing where an image forming operation is not performed (during a non-image forming period). Examples of a non-image forming period include during post-rotation and during a processing operation after an occurrence of jamming in which the recording medium 12 becomes jammed midway along a conveying path.

In the ejection process, the conductive brush 51 and the toner charging roller 52 are charged with a same polarity as the trapped toner. In this case, a bias with a negative polarity is applied to the conductive brush 51 and the toner charging roller 52. Accordingly, a negative electric field is formed from the conductive brush 51 and the toner charging roller 52 toward the intermediate transfer belt 20. Most of the trapped toner on the conductive brush 51 and the toner charging roller 52 have a negative polarity. Therefore, applying a negative bias to the conductive brush 51 and the toner charging roller 52 causes the trapped toner on the conductive brush 51 and the toner charging roller 52 to be transferred onto the intermediate transfer belt 20 due to an electrostatic attractive force. Accordingly, the toner stored on the conductive brush 51 and the trapped toner on the surface of the toner charging roller 52 are ejected to the intermediate transfer belt 20. The trapped toner transferred to the intermediate transfer belt 20 is guided by the primary transfer unit, and by applying a bias with a same polarity as the trapped toner to the primary transfer roller 21, the trapped toner is reverse-transferred from the intermediate transfer belt 20 to the photosensitive drum 1 and removed from the intermediate transfer belt 20. The waste toner storage portion 13*a* is configured to also collect trapped toner removed from the intermediate transfer belt 20.

A feature of the image forming apparatus 100 is that waste toner conveyance control is performed by also taking into consideration an increase in an amount of stored waste toner due to trapped toner being collected in the waste toner storage portion 13*a*. Adhering toner refers to toner which is ejected to the intermediate transfer belt 20 by the ejection process and subsequently removed from the intermediate transfer belt 20.

For the ejection process of such trapped toner charged with a negative polarity, negative biases are applied to the conductive brush 51 and the toner charging roller 52 from the high-voltage power supplies 54 and 56. In this case, it is assumed that the negative bias applied from the high-voltage power supply 54 to the conductive brush 51 is −1000 V and the negative bias applied from the high-voltage power supply 56 to the toner charging roller 52 is −1500 V. Note that the values described above are merely examples and the biases are not limited thereto.

Although most of the trapped toner on the conductive brush 51 and the toner charging roller 52 are charged with a negative polarity, there is a small amount of trapped toner charged with a positive polarity due to discharge. In consideration thereof, in order to eject the trapped toner charged with a positive polarity to the intermediate transfer belt 20, the ejection process includes a step of applying a positive bias to the conductive brush 51 and the toner charging roller 52. Accordingly, a positive electric field is formed from the conductive brush 51 and the toner charging roller 52 toward the intermediate transfer belt 20, and even the small amount of trapped toner with a positive polarity on the conductive brush 51 and the toner charging roller 52 can be ejected to the intermediate transfer belt 20.

For the ejection process of such trapped toner charged with a positive polarity, positive biases are applied to the conductive brush 51 and the toner charging roller 52 from the high-voltage power supplies 54 and 56. In this case, it is assumed that the positive bias applied from the high-voltage power supply 54 to the conductive brush 51 is +1000 V and the positive bias applied from the high-voltage power supply 56 to the toner charging roller 52 is +1500 V. Note that the values described above are merely examples and the biases are not limited thereto.

In the ejection process, the biases applied to the conductive brush 51 and the toner charging roller 52 are alternately switched between positive and negative while rotating the intermediate transfer belt 20. An electric field formed between the conductive brush 51 and the intermediate transfer belt 20 and an electric field formed between the toner charging roller 52 and the intermediate transfer belt 20 alternate between positive and negative. Accordingly, since trapped toner charged with a positive polarity and trapped toner charged with a negative polarity on the conductive brush 51 and the toner charging roller 52 are both ejected to the intermediate transfer belt 20, a decline in the cleaning effect due to the belt cleaner 27 can be suppressed.

A collection process in which toner ejected to the intermediate transfer belt 20 from the conductive brush 51 and the toner charging roller 52 by the ejection process is collected by the primary transfer unit will now be described.

During the ejection process, the intermediate transfer belt 20 rotates in a direction of an arrow B. The trapped toner ejected to the intermediate transfer belt 20 is reverse-transferred to the photosensitive drum 1 by the primary transfer unit on a downstream side of the belt cleaner 27, collected by the drum cleaner 6, and stored in the waste toner storage portion 13*a*.

The ejection process is executed during a non-image forming period such as during post-rotation. The collection process of the residual toner after the secondary transfer described in the second embodiment is performed during an image forming operation and the residual toner after the secondary transfer is collected by the first (Y) station that is the most upstream station. In consideration thereof, in order to prevent the amount of the stored waste toner of the waste toner storage portion 13*a* of the first (Y) station from increasing, the trapped toner transferred to the intermediate transfer belt 20 in the ejection process is collected by the second (M) station.

The ejection process is executed after the residual toner after the secondary transfer in all image forming periods related to the continuous image formation command passes the conductive brush 51 and the toner charging roller 52. First, positive and negative biases are alternately applied to the conductive brush 51 and the toner charging roller 52. A negative bias V2=−1000 V and a positive bias V1=1000 V are alternately applied to the conductive brush 51, and a negative bias V4=−1500 V and a positive bias V3=1500 V are alternately applied to the toner charging roller 52. Accordingly, the toner trapped in the conductive brush 51 and the toner trapped in the surface of the toner charging roller 52 are transferred to the intermediate transfer belt 20.

Most of the trapped toner transferred to the intermediate transfer belt 20 in the ejection process is toner with a negative polarity. In order to collect the ejected trapped toner with the second station, when the ejected trapped toner passes the first (Y) station, a positive bias is applied to the primary transfer roller 21*y* of the first station. On the other hand, when the ejected trapped toner passes the second (M) station, a negative bias is applied to the primary transfer roller 21*m* of the second station. Accordingly, trapped toner with a negative polarity which is ejected from the conductive brush 51 and the toner charging roller 52 is not collected in the first station but collected in the second station.

The trapped toner ejected in the ejection process also includes a small amount of toner with a positive polarity. Such trapped toner with a positive polarity is collected in the first station due to a positive bias being applied to the primary transfer roller 21*y* of the first station.

While an example in which most of the trapped toner ejected in the ejection process is collected in the second station has been described, the trapped toner may be collected in another station or the collection may be performed in a distributed manner by a plurality of stations without limiting the collection to one station.

The trapped toner ejected by the ejection process performed during post-rotation which is a non-image forming period is collected in the second station. Therefore, the determination of whether or not the second conveyance control is to be executed is made in view of an increase in the amount of the stored waste toner of the waste toner storage portion 13*a* of the second station due to the collection of the ejected trapped toner. In other words, when a value obtained by adding an amount of the trapped toner ejected in the ejection process during post-rotation having been collected in the second station to the amount of the stored waste toner of the waste toner storage portion 13*a* of the second station equals or exceeds the threshold TH, the second conveyance control is executing during the post-rotation.

Moreover, the amount of the stored waste toner is calculated by ignoring trapped toner with a positive polarity which is ejected in the ejection process since an amount thereof is minute and by assuming that the trapped toner ejected in the ejection process is entirely toner with a negative polarity.

In the third embodiment, whether or not second conveyance control is to be executed is determined based on the amount of the stored waste toner of the second (M) station.

Figure 9:
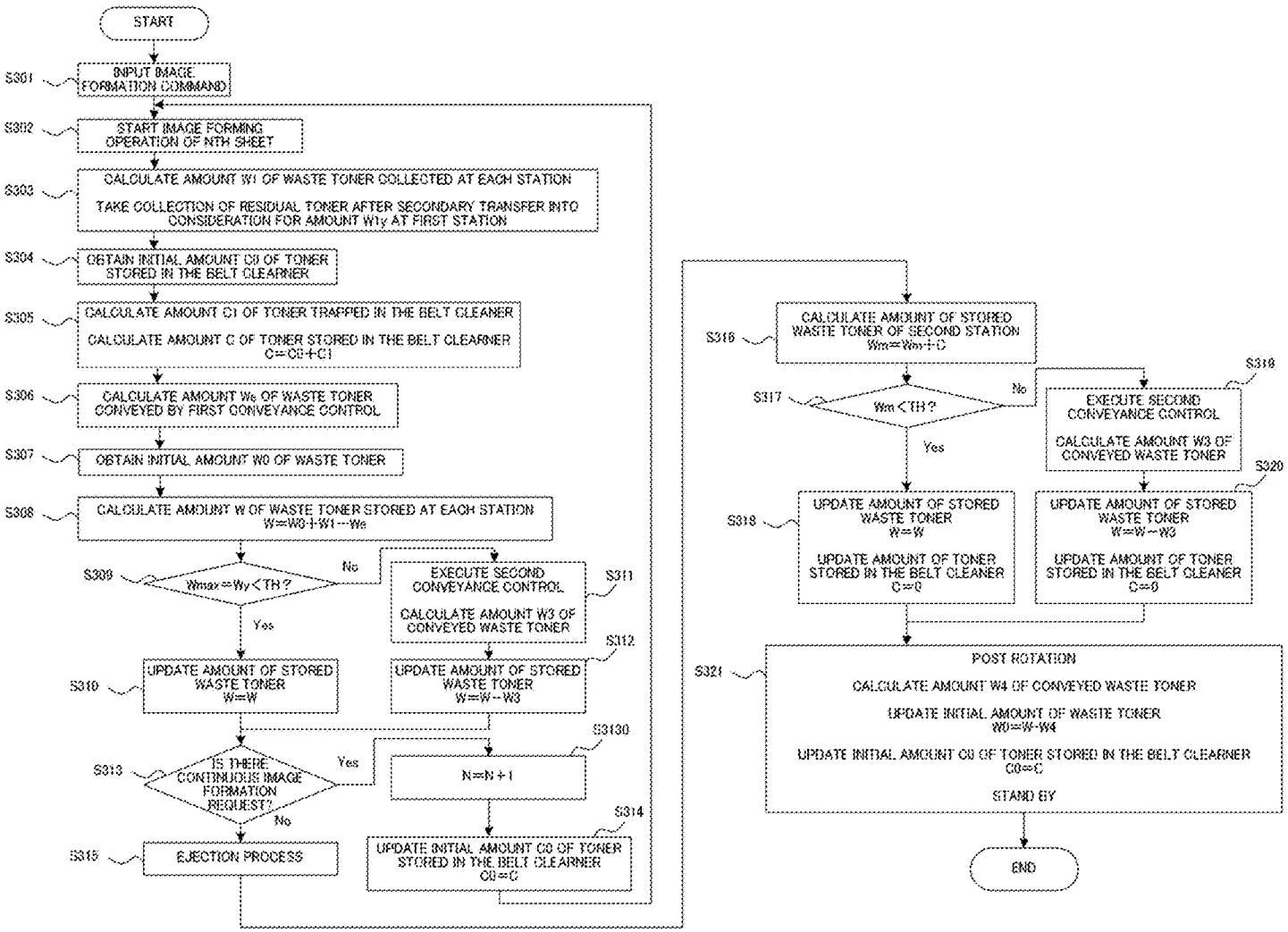
FIG. 9 is a flow chart related to a waste toner collection operation according to a third embodiment.

Waste toner conveyance control in the image forming apparatus 100 according to the third embodiment will now be described with reference to the flow chart shown in FIG. 9. FIG. 9 is a flow chart showing a flow of waste toner conveyance control of the third embodiment. The processes represented by the flow chart are executed by the controller 62 of the image forming apparatus 100.

In S301, the controller 62 accepts an input of an image formation command from the host 61.

In S302, the controller 62 causes the image forming apparatus 100 to start an image forming operation with respect to the Nth sheet of recording medium. This process is similar to S102 in the first embodiment.

In S303, the controller 62 obtains an amount of waste toner generated by image formation on the Nth sheet of recording medium. First, the controller 62 obtains amounts W1 (W1*y*, W1*m*, W1*c*, and W1*k*) of the collected waste toner in the first (Y) to fourth (K) stations. The calculation method is similar to that of S203 according to the second embodiment.

In S304, the controller 62 obtains an amount C0 of the residual toner after the secondary transfer charged with a negative polarity and stored in the belt cleaner 27 (the conductive brush 51 and the toner charging roller 52) by the end of a previous image formation (image formation of an N-1th sheet). This amount of the residual toner after the secondary transfer is referred to as an initial amount of toner stored in the belt cleaner. As the initial amount C0 of toner stored in the belt cleaner, the controller 62 uses an amount C of toner stored in the belt cleaner obtained during the previous image forming period. The controller 62 stores, in the memory 64, the amount C of toner stored in the belt cleaner obtained during the image forming period as the initial amount C0 of toner stored in the belt cleaner to be used during a next image forming period. The controller 62 reads and obtains the initial amount C0 of toner stored in the belt cleaner stored in this manner from the memory 64.

In S305, the controller 62 calculates an amount C of the residual toner after the secondary transfer charged with a negative polarity and stored in the belt cleaner 27 (the conductive brush 51 and the toner charging roller 52) by the present image formation (image formation of an Nth sheet). This amount of the residual toner after the secondary transfer is referred to as an amount of waste toner stored in the belt cleaner. First, based on the amount of the residual toner after the secondary transfer generated by the image formation of the Nth sheet and on the cleaning efficiency I, the controller 62 calculates an amount C1 of toner trapped in the belt cleaner 27 during an image forming period from the following equation.

$$C1=(1-I)\times(Ay\times Dy\times Ty+Am\times Dm\times Tm+Ac\times Dc\times Tc+Ak\times Dk\times Tk)$$

The controller 62 adds up the obtained amount C1 of toner trapped in the belt cleaner and the initial amount C0 of toner stored in the belt cleaner obtained in S304 to obtain the amount C of toner stored in the belt cleaner from the following equation.

$$C=C1+C0$$

In S306, the controller 62 obtains an amount We of waste toner conveyed to the main body of the image forming apparatus 100 by the first conveyance control. This process is similar to S104 in the first embodiment.

In S307, the controller 62 obtains the initial amount W0 of waste toner. This process is similar to S105 in the first embodiment.

In S308, the controller 62 obtains an amount W of the stored waste toner in the waste toner storage portion 13*a* of each station after the image forming operation. This process is similar to S106 in the first embodiment.

In S309, the controller 62 compares the amount Wy of the stored waste toner of the first (Y) station among the amounts W (Wy, Wm, Wc, and Wk) of the stored waste toner of the respective stations obtained in S308 with the threshold TH. This process is similar to S207 in the second embodiment. When Wy is smaller than the threshold TH, the controller 62 advances to S310, but when Wy is equal to or larger than the threshold TH, the controller 62 advances to S311.

In S310, the controller 62 stores the amount W of the stored waste toner (Wy, Wm, Wc, and Wk) of each station obtained in S308 in the memory 64, and updates information on the amount of the stored waste toner which has already been stored. This process is similar to S208 in the second embodiment.

In S311, the controller 62 temporarily stops the continuous image forming operation and executes the second conveyance control. If an amount of waste toner conveyed by the second conveyance control is denoted by W3, the amount W of the stored waste toner of the waste toner storage portion 13*a* of each station is reduced by W3. Accordingly, since the amount W of the stored waste toner of the waste toner storage portion 13*a* of each station decreases, an occurrence of a problem such as clogging of waste toner in the waste toner storage portion 13*a* or a conveying path can be suppressed. Details of the second conveyance control are similar to those of the first embodiment. W3 may be set to an appropriate value based on a difference between the maximum value Wmax of the amount of the stored waste toner and the threshold TH so that executing the second conveyance control causes the amount W of the stored waste toner of the waste toner storage portion 13*a* of each station to become smaller than the threshold TH.

In S312, the controller 62 obtains a value (W−W3) by subtracting the amount W3 of the waste toner conveyed by the second conveyance control from the amount W of the stored waste toner obtained in S308, and updates information on the amount of the stored waste toner in the memory 64. This process is similar to S110 in the first embodiment.

In S313, the controller 62 checks whether or not a continuous image formation request has been made. At this point, the controller 62 determines whether or not N<M. When N<M, the controller 62 determines that a continuous image formation request has been made, advances to S3130 and increments N, and advances to S314. When a continuous image formation request has not been made, the controller 62 advances to S315. At this point, when N≥M, the controller 62 determines that a continuous image formation request has not been made (image formation of all recording mediums related to the continuous image formation request has been finished).

In S314, the controller 62 updates the value of the initial amount C0 of toner stored in the belt cleaner stored in the memory 64 to the amount C of toner stored in the belt cleaner obtained in S305. Subsequently, the process returns to S303.

In S315, the controller 62 executes an ejection process of toner stored in the belt cleaner 27.

In S316, the controller 62 obtains the amount W of the stored waste toner in view of an increase in the amount of the stored waste toner of the waste toner storage portion 13*a* due to the ejection process in S315. In the third embodiment, the waste toner generated by the ejection process is collected in the second (M) station. The waste toner generated by the ejection process is entirely assumed to have a negative polarity. It is assumed that, due to the ejection process, all of the waste toner stored in the belt cleaner 27 is discharged. Therefore, the controller 62 obtains the amount Wm of the stored waste toner of the second station from the following equation using the amount C of toner stored in the belt cleaner obtained in S305 and the amount Wm of the stored waste toner of the second station up to immediately before the start of the ejection process obtained in S310 or S312.

$$Wm=Wm+C$$

In S317, the controller 62 compares the amount Wm of the stored waste toner of the second station obtained in S316 with a threshold TH. When Wm is smaller than the threshold TH, the controller 62 advances to S318, but when Wm is equal to or larger than the threshold TH, the controller 62 advances to S319.

In S318, the controller 62 stores the amount Wm of the stored waste toner of the second station obtained in S316 in the memory 64, and updates information on the amount of the stored waste toner which has already been stored. In addition, the controller 62 updates the value of the amount C of toner stored in the belt cleaner stored in the memory 64 to 0.

In S319, the controller 62 executes the second conveyance control. If an amount of waste toner conveyed by the second conveyance control is denoted by W3, the amount W of the stored waste toner of the waste toner storage portion 13*a* of each station is reduced by W3. Accordingly, since the amount W of the stored waste toner of the waste toner storage portion 13*a* of each station decreases, an occurrence of a problem such as clogging of waste toner in the waste toner storage portion 13*a* or a conveying path can be suppressed. Details of the second conveyance control are similar to those of the first embodiment. W3 may be set to an appropriate value based on a difference between the maximum value Wmax of the amount of the stored waste toner and the threshold TH so that executing the second conveyance control causes the amount W of the stored waste toner of the waste toner storage portion 13*a* of each station to become smaller than the threshold TH.

In S320, the controller 62 obtains a value (W−W3) by subtracting the amount W3 of the waste toner conveyed by the second conveyance control from the amounts Wy, Wc, and Wk of the stored waste toner obtained in S310 or S312 and the amount Wm of the stored waste toner obtained in S316. The controller 62 stores the obtained value in the memory 64, and updates information on the amount of the stored waste toner in the memory 64. In addition, the controller 62 updates the value of the amount C of toner stored in the belt cleaner stored in the memory 64 to 0.

In S321, the controller 62 executes post-rotation, obtains an amount W4 of conveyed waste toner due to the post-rotation, and obtains a value (W−W4) by subtracting the amount W4 of the conveyed waste toner from the amount W of the stored waste toner obtained in S320. The controller 62 stores the obtained value as the initial amount W0 of waste toner stored in the waste toner storage portion 13*a* of each station in the memory 64, and updates information on the initial amount of waste toner. In addition, the controller 62 updates the value of the initial amount C0 of toner stored in the belt cleaner to the amount C of toner stored in the belt cleaner obtained in S318 or S320. Subsequently, the controller 62 causes a transition to be made to an image forming operation stand-by state.

According to the image forming apparatus in the third embodiment, even with a configuration in which the residual toner after the secondary transfer is collected by the photosensitive unit 13 of the process cartridge 7, an amount of stored waste toner of the waste toner storage portion 13*a* is obtained and, when the amount of the stored waste toner is equal to or greater than a threshold, the second conveyance control is executed. As a result, the amount of the stored waste toner of the waste toner storage portion 13*a* can be prevented from becoming excessive and clogging and the like of waste toner can be prevented from occurring in the waste toner storage portion 13*a*. In addition, a decline in the cleaning effect by the belt cleaner 27 can be suppressed. Moreover, an example has been described in which whether or not second conveyance control is to be executed is determined in S309 by comparing the amount Wy of the stored waste toner of the first (Y) station which performs collection of the residual toner after the secondary transfer with the threshold TH. However, in a similar manner to the first embodiment, the maximum value Wmax among the amounts of the stored waste toner of all stations may be compared with the threshold TH. In addition, an example has been described in which whether or not second conveyance control is to be executed is determined in S317 by comparing the amount Wm of the stored waste toner of the second (M) station which performs collection of the trapped toner ejected in an ejection process with the threshold TH. However, in a similar manner to the first embodiment, the maximum value Wmax among the amounts of the stored waste toner of all stations may be compared with the threshold TH.

Modifications

The respective embodiments describe an example in which the present invention is applied to an image forming apparatus configured such that a toner image transferred from a photosensitive drum to an intermediate transfer belt by the primary transfer unit is transferred from the intermediate transfer belt to a recording medium by the secondary transfer unit. However, the present invention can also be applied to an image forming apparatus configured such that a toner image is transferred to a recording medium from the photosensitive drum.

The respective embodiments describe an example in which an amount of stored waste toner is obtained in view of a toner amount that is conveyed from the waste toner storage portion 13*a* to the waste toner box 26 as the conveying unit is driven by a preparatory rotation of the photosensitive drum 1 after image formation. In addition thereto or in place thereof, an amount of stored waste toner may be obtained in view of a toner amount that is conveyed from the waste toner storage portion 13*a* to the waste toner box 26 as the conveying unit is driven by a preparatory rotation of the photosensitive drum 1 before image formation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-190428, filed on Sep. 29, 2017 and Japanese Patent Application No. 2018-124714, filed on Jun. 29, 2018, which are hereby incorporated by reference herein in their entirety.

What is claimed is:

1. An image forming apparatus, comprising:

an image bearing member which is rotationally driven;

a developing unit which, during an image forming period, is arranged to supply toner to the image bearing member and to form a toner image on the image bearing member;

a transfer unit which is arranged to transfer the toner image to an intermediate transfer member or a recording medium;

a first cleaning unit which is arranged to remove, from the image bearing member, toner remaining on a surface of the image bearing member after the toner image is transferred to the intermediate transfer member or recording medium;

a first storage unit arranged to receive and collect toner removed by the first cleaning unit;

a conveying unit which is arranged to be driven by transmission of a rotation of the image bearing member to convey toner stored in the first storage unit to a distinct second storage unit; and a control unit which is arranged to perform conveyance control, by driving the image bearing member to rotate during a non-image forming time period, during which time period the conveying unit is caused to convey toner from the first storage unit to the second storage unit, wherein the control unit being arranged to calculate an amount of toner, stored in the first storage unit, during the image forming period, and when the amount of stored toner is equal to or larger than a prescribed threshold, the control unit is arranged to execute the conveyance, during the non-image forming period, of toner from the first storage unit to the second storage unit, to reduce the amount of toner stored in the first storage unit.

2. The image forming apparatus according to claim 1, wherein the control unit is arranged to calculate the amount of toner stored in the first storage unit each time image formation on one sheet of recording medium is performed during an image forming period of a plurality of sheets of recording medium, and when the amount of stored toner is equal to or larger than the threshold, the control unit is arranged to temporarily stop the image formation and to execute the conveyance control to transfer toner from the first storage unit to the second storage unit.

3. The image forming apparatus according to claim 1, comprising a plurality of cartridges each having the image bearing member, the developing unit, the transfer unit, the first cleaning unit, and the first storage unit, wherein the second storage unit is provided outside of the plurality of cartridges, the conveying unit is arranged to convey toner stored in the first storage unit of each of the plurality of cartridges to the second storage unit, and the control unit is arranged calculate the amount of toner stored in the first storage unit of each of the plurality of cartridges during the image forming period, and when a maximum value among the plurality of calculated amounts of stored toner is equal to or larger than the threshold, the control unit executes the conveyance control during the non-image forming period.

4. The image forming apparatus according to claim 1, further comprising:

a primary transfer unit which is arranged to transfer the toner image on the image bearing member to the intermediate transfer member;

a secondary transfer unit which is arranged to transfer the toner image on the intermediate transfer member to the recording medium; and a second cleaning unit which reverse-transfers, to the image bearing member, residual toner that remains on the intermediate transfer member after the toner image is transferred to the recording medium to remove the residual toner from the intermediate transfer member, wherein the first storage unit is arranged to collect the residual toner removed from the intermediate transfer member, and the control unit is arranged to calculate the amount of toner stored in the first storage unit based on an amount of the residual toner collected in the first storage unit.

5. The image forming apparatus according to claim 4, wherein the second cleaning unit has a charging unit which is arranged to charge the residual toner, the second cleaning unit being arranged to transfer trapped toner that is trapped in the charging unit to the intermediate transfer member, and subsequently reverse-transfer the trapped toner transferred to the intermediate transfer member to the image bearing member to remove the trapped toner from the intermediate transfer member, the first storage unit is configured to collect the trapped toner removed from the intermediate transfer member, and the control unit is arranged to calculate the amount of toner stored in the first storage unit based on an amount of the trapped toner collected in the first storage unit.

6. The image forming apparatus according to claim 1, wherein the control unit is arranged to calculate the amount of toner stored in the first storage unit based on an amount of toner conveyed from the first storage unit to the second storage unit as the conveying unit is driven by a pre-rotation of the image bearing member before performing the image formation and a post-rotation of the image bearing member after performing the image formation.

7. The image forming apparatus according to claim 1, wherein the control unit is arranged to calculate the amount of the stored toner based on image data related to the image formation.

8. The image forming apparatus according to claim 7, wherein the control unit is arranged to calculate the amount of the collected toner based on at least one of a primary transfer efficiency, T, which is a proportion of toner on the image bearing member being transferred to the intermediate transfer member or the recording medium, and a retransfer efficiency, R, which is a proportion of toner transferred to the intermediate transfer member or the recording medium being transferred to the image bearing member.

9. The image forming apparatus according to claim 7, wherein the control unit is arranged to calculate the amount of stored toner every time image formation is performed on one sheet of recording medium.

10. The image forming apparatus according to claim 1, wherein the developing unit includes a developer bearing member which is rotationally driven, and the control unit is arranged to control rotational driving of the image bearing member and the developer bearing member during an image forming period by a first control mode and a second control mode in accordance with image quality settings of image formation, wherein in the first and second control modes, a ratio of a peripheral velocity of the developer bearing member to a peripheral velocity of the image bearing member is a first and second ratio respectively; and wherein the second ratio is higher than the first ratio.

11. The image forming apparatus according to claim 10, wherein the control unit performs the conveyance control when the second control mode is set as a control mode of rotational drive of the image bearing member and the developer bearing member during an image forming period.

12. An image forming apparatus, comprising:

an image bearing member which bears a developer image;

a frame body which rotatably supports the image bearing member and which has a storage portion that stores a developer collected from a surface of the image bearing member;

a conveying member which is supported by the frame body so as to rotate and which is configured to operate, driven by transmission of a drive force that rotates the image bearing member, conveyance in which a developer stored in the storage portion is conveyed from the inside of the storage portion to the outside of the storage portion; and a control unit which causes the conveying member to operate the conveyance, wherein the control unit is arranged to calculate an amount of the developer stored in the storage portion during an image forming time period, and when the amount of the stored developer is equal to or larger than a threshold, the control unit is arranged to cause the conveyance operation of toner from the inside of the storage portion to the outside of the storage portion to be executed during a non-image forming period to reduce the amount of the developer stored in the storage portion.

* * * * *